US007524808B2

(12) United States Patent
Fütterer et al.

(10) Patent No.: US 7,524,808 B2
(45) **Date of Patent: *Apr. 28, 2009**

(54) HARD SURFACE CLEANING COMPOSITION WITH HYDROPHILIZING AGENT AND METHOD FOR CLEANING HARD SURFACES

(75) Inventors: Tobias Johannes Fütterer, Singapore (SG); Lawrence Alan Hough, Philadelphia, PA (US); Robert Lee Reierson, Princeton Junction, NJ (US)

(73) Assignee: Rhodia Inc., Cranbury, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/137,738

(22) Filed: Jun. 12, 2008

(65) Prior Publication Data

US 2008/0312118 A1 Dec. 18, 2008

Related U.S. Application Data

(60) Provisional application No. 60/943,517, filed on Jun. 12, 2007.

(51) Int. Cl.
*C11D 7/36* (2006.01)
*C11D 3/37* (2006.01)

(52) U.S. Cl. ..... 510/467; 510/130; 510/131; 510/136; 510/220; 510/228; 510/235; 510/236; 510/189; 510/288; 510/319; 510/347; 510/390; 510/423; 510/431; 510/436

(58) Field of Classification Search ..... 510/130, 510/131, 136, 150, 228, 236, 288, 319, 347, 510/390, 423, 431, 436, 467, 220, 235, 189
See application file for complete search history.

(56) References Cited

U.S. PATENT DOCUMENTS

| | | | | |
|---|---|---|---|---|
| 2,438,091 | A | | 3/1948 | Lynch |
| 2,524,218 | A | | 10/1950 | Bersworth |
| 2,528,378 | A | | 10/1950 | Mannheimer |
| 2,530,147 | A | | 11/1950 | Bersworth |
| 2,658,072 | A | | 11/1953 | Kosmin |
| 2,826,551 | A | | 3/1958 | Geen |
| 2,874,074 | A | | 2/1959 | Johnson |
| 2,946,725 | A | | 7/1960 | Norris et al. |
| 3,033,704 | A | | 5/1962 | Sherrill et al. |
| 3,070,510 | A | | 12/1962 | Cooley et al. |
| 3,244,724 | A | | 4/1966 | Guttmann |
| 3,308,067 | A | | 3/1967 | Diehl |
| 3,332,880 | A | | 7/1967 | Kessler et al. |
| 3,538,230 | A | | 11/1970 | Pader et al. |
| 3,553,139 | A | | 1/1971 | McCarty |
| 3,598,865 | A | | 8/1971 | Lew |
| 3,599,716 | A | | 8/1971 | Thompson |
| 3,678,154 | A | | 7/1972 | Widder et al. |
| 3,681,241 | A | | 8/1972 | Rudy |
| 3,717,630 | A | | 2/1973 | Booth |
| 3,723,322 | A | | 3/1973 | Diehl |
| 3,793,209 | A | | 2/1974 | Thompson |
| 3,850,831 | A | * | 11/1974 | Hellsten et al. ..... 510/371 |
| 3,862,307 | A | | 1/1975 | Di Giulio |
| 3,869,412 | A | * | 3/1975 | Waag ..... 510/467 |
| 3,893,929 | A | | 7/1975 | Basadur |
| 3,912,681 | A | | 10/1975 | Dickson |
| 3,939,911 | A | | 2/1976 | Maddox, Jr. et al. |
| 3,948,838 | A | | 4/1976 | Hinton, Jr. et al. |
| 3,956,198 | A | | 5/1976 | Bauer |
| 3,959,230 | A | | 5/1976 | Hays |
| 3,959,458 | A | | 5/1976 | Agricola et al. |
| 3,964,500 | A | | 6/1976 | Drakoff |
| 3,976,586 | A | | 8/1976 | Chakrabarti |
| 4,001,133 | A | | 1/1977 | Sorgenfrei et al. |
| 4,008,165 | A | | 2/1977 | Maddox, Jr. et al. |
| 4,017,410 | A | | 4/1977 | Sorgenfrei et al. |
| 4,038,027 | A | | 7/1977 | Kearney |
| 4,049,558 | A | | 9/1977 | Rasmussen |
| 4,051,234 | A | | 9/1977 | Gieske et al. |
| 4,101,457 | A | | 7/1978 | Place et al. |
| 4,116,984 | A | | 9/1978 | Prinzbach et al. |
| 4,127,489 | A | | 11/1978 | Pracht et al. |
| 4,144,226 | A | | 3/1979 | Crutchfield et al. |
| 4,146,495 | A | | 3/1979 | Crutchfield et al. |
| 4,152,416 | A | | 5/1979 | Spitzer et al. |

(Continued)

FOREIGN PATENT DOCUMENTS

| | | |
|---|---|---|
| DE | 2829022 | 1/1980 |

(Continued)

OTHER PUBLICATIONS

U.S. Appl. No. 12/137,589 "Mono-, Di- and Polyol Phosphate Esters in Personal Care Formulations", Futterer et al., filed Jun. 12, 2008.

(Continued)

*Primary Examiner*—Charles I Boyer
(74) *Attorney, Agent, or Firm*—Novak Druce + Quigg, LLP

(57) ABSTRACT

A composition for cleaning or rinsing hard surfaces in an aqueous or aqueous/alcoholic medium including at least one organophosphorus material for contributing to said surfaces antideposition and/or antiadhesion properties with regard to soiling substances capable of being deposited on the surfaces.

51 Claims, 3 Drawing Sheets

U.S. PATENT DOCUMENTS 4,152,421 A 5/1979 Tsutsumi et al.
4,206,215 A 6/1980 Bailey
4,235,735 A 11/1980 Marco et al.
4,240,919 A 12/1980 Chapman
4,261,868 A 4/1981 Hora et al.
4,264,580 A 4/1981 Barberio
4,278,129 A 7/1981 Walton
4,287,080 A 9/1981 Siklosi
4,321,256 A 3/1982 Hasegawa et al.
4,350,680 A 9/1982 Harvey et al.
4,364,837 A 12/1982 Pader
4,391,722 A * 7/1983 Schwartz et al. ..... 252/73
4,393,935 A 7/1983 Walton
4,470,923 A 9/1984 Koster
4,483,779 A 11/1984 Llenado et al.
4,507,219 A 3/1985 Hughes
4,525,291 A * 6/1985 Smith et al. ..... 510/303
4,536,317 A 8/1985 Llenado et al.
4,536,318 A 8/1985 Cook et al.
4,536,319 A 8/1985 Payne
4,541,483 A 9/1985 Walton
4,548,744 A 10/1985 Connor
4,557,853 A 12/1985 Collins
4,559,056 A 12/1985 Leigh et al.
4,565,647 A 1/1986 Llenado
4,579,681 A 4/1986 Ruppert et al.
4,597,898 A 7/1986 Vander Meer
4,599,188 A 7/1986 Llenado
4,614,519 A 9/1986 Ruppert et al.
4,627,977 A 12/1986 Gaffar et al.
4,664,839 A 5/1987 Rieck
4,702,857 A 10/1987 Gosselink
4,711,730 A 12/1987 Gosselink et al.
4,721,580 A 1/1988 Gosselink
4,728,455 A 3/1988 Rerek
4,734,099 A 3/1988 Cyprien
4,746,456 A 5/1988 Kud et al.
4,752,409 A 6/1988 Drapier et al.
4,770,666 A 9/1988 Clauss
4,801,395 A 1/1989 Chazard et al.
4,813,482 A 3/1989 Walton
4,836,949 A 6/1989 Klajnscek
4,859,358 A * 8/1989 Gabriel et al. ..... 510/222
4,877,896 A 10/1989 Maldonado et al.
4,886,609 A 12/1989 Walton
4,891,160 A 1/1990 Vander Meer
4,894,220 A 1/1990 Nabi et al.
4,902,499 A 2/1990 Bolish, Jr. et al.
4,933,101 A 6/1990 Cilley et al.
4,968,451 A 11/1990 Scheibel et al.
4,976,879 A 12/1990 Maldonado et al.
5,015,466 A 5/1991 Parran, Jr. et al.
5,019,373 A 5/1991 Carter et al.
5,038,864 A 8/1991 Dunleavy
5,064,553 A 11/1991 Dixit et al.
5,098,590 A 3/1992 Dixit et al.
5,104,643 A 4/1992 Grollier et al.
5,114,606 A 5/1992 van Vliet et al.
5,130,043 A 7/1992 Prince et al.
5,160,450 A 11/1992 Okahara et al.
5,236,615 A 8/1993 Trinh et al.
5,280,117 A 1/1994 Kerschner et al.
5,332,528 A 7/1994 Pan et al.
5,370,865 A 12/1994 Yamagishi et al.
5,405,542 A 4/1995 Trinh et al.
5,413,727 A 5/1995 Drapier et al.
5,415,807 A 5/1995 Gosselink et al.
5,415,860 A 5/1995 Beucherie et al.
5,510,042 A 4/1996 Hartman et al.
5,510,306 A 4/1996 Murray
5,534,197 A 7/1996 Scheibel et al.
5,550,274 A 8/1996 Reierson
5,554,781 A 9/1996 Reierson
5,559,261 A 9/1996 Sivik
5,565,145 A 10/1996 Watson et al.
5,573,709 A 11/1996 Wells
5,607,680 A 3/1997 Brissonnet et al.
5,648,584 A 7/1997 Murray
5,648,585 A 7/1997 Murray et al.
5,686,024 A 11/1997 Dahanayake et al.
5,710,121 A 1/1998 Tracy et al.
5,798,326 A 8/1998 Goldstein et al.
5,804,542 A 9/1998 Scheper et al.
5,824,289 A 10/1998 Stoltz
5,849,960 A 12/1998 Singleton et al.
5,853,710 A 12/1998 Dehan et al.
5,858,343 A 1/1999 Szymczak
5,879,469 A * 3/1999 Avram ..... 134/25.2
5,902,574 A 5/1999 Stoner et al.
5,902,778 A 5/1999 Hartmann et al.
5,939,052 A 8/1999 White, Jr. et al.
5,968,893 A 10/1999 Manohar et al.
6,017,936 A 1/2000 Polson et al.
6,136,221 A 10/2000 Reierson
6,149,693 A 11/2000 Geib
6,150,222 A 11/2000 Gardner et al.
6,187,391 B1 2/2001 Kataoka et al.
6,220,352 B1 4/2001 Walton
6,222,077 B1 4/2001 Singleton
6,242,404 B1 6/2001 Dahanayake et al.
6,271,409 B1 8/2001 Geib
6,297,201 B1 10/2001 Geib
6,342,468 B1 1/2002 Geib
6,387,137 B1 5/2002 Geib
6,525,005 B1 * 2/2003 Kravitz et al. ..... 508/438
6,566,313 B1 5/2003 Hohenstein et al.
6,569,261 B1 5/2003 Aubay et al.
6,579,466 B1 6/2003 David et al.
6,593,288 B2 7/2003 Aubay et al.
6,767,410 B2 7/2004 Aubay et al.
6,767,560 B2 7/2004 Paek
6,864,314 B1 3/2005 Yeung et al.
6,924,260 B2 8/2005 Aubay
7,262,153 B2 8/2007 Shpakoff et al.
7,381,695 B2 * 6/2008 Minevski ..... 510/189
2003/0044469 A1 3/2003 Petit et al.
2003/0228339 A1 12/2003 El-Nokaly et al.
2004/0185027 A1 9/2004 Reierson et al.
2004/0247534 A1 12/2004 Stoltz
2005/0020466 A1 * 1/2005 Man et al. ..... 510/392
2005/0184273 A1 8/2005 Morelli et al.
2006/0088482 A1 4/2006 Wulknitz et al.
2006/0093559 A1 5/2006 Fabry
2006/0135384 A1 6/2006 Luu et al.
2006/0159631 A1 7/2006 Buch et al.
2006/0217286 A1 9/2006 Geoffroy et al.
2007/0145617 A1 6/2007 Finney et al.
2007/0166243 A1 7/2007 Yoshida et al.
2008/0028986 A1 2/2008 Futterer et al.
2008/0095719 A1 4/2008 Herrmann et al.
2008/0220031 A1 9/2008 Wunsch et al.

FOREIGN PATENT DOCUMENTS

EP 0011984 6/1980
EP 0066915 12/1982
EP 0132043 1/1985
EP 0132046 1/1985
EP 0219048 4/1987
EP 0488868 6/1992
EP 0561656 9/1993
EP 0909809 4/1999
EP 1196523 4/2002
EP 1196527 4/2002

| | | | |
|---|---|---|---|
| EP | 1196528 | | 4/2002 |
| FR | 2236926 | | 2/1975 |
| FR | 2334698 | | 7/1977 |
| GB | 849433 | | 9/1960 |
| GB | 1314897 | | 4/1973 |
| GB | 1475798 | | 6/1977 |
| GB | 1498520 | | 1/1978 |
| GB | 1537288 | | 12/1978 |
| GB | 1578930 | | 11/1980 |
| GB | 2 192 194 | A | 1/1988 |
| GB | 2 283 036 | A | 4/1995 |
| GB | 2 283 755 | A | 5/1995 |
| JP | 3157323 | A | 7/1991 |
| JP | 047547 | | 1/1992 |
| JP | 6313271 | | 11/1994 |
| JP | 2003342140 | A | 12/2003 |
| JP | 2005-013929 | | 1/2005 |
| WO | 9532272 | | 11/1995 |
| WO | 9532997 | | 12/1995 |
| WO | 9623859 | | 8/1996 |
| WO | 9623860 | | 8/1996 |
| WO | 9623861 | | 8/1996 |
| WO | 97/42287 | A1 | 11/1997 |
| WO | 9742288 | | 11/1997 |
| WO | 9838973 | | 9/1998 |
| WO | 9841505 | | 9/1998 |
| WO | 2004/082500 | A2 | 9/2004 |

OTHER PUBLICATIONS

U.S. Appl. No. 12/137,647 "Mono-, Di- and Polyol Alkoxylate Phosphate Esters in Oral Care Formulations and Methods for Using Same", Futterer et al., filed Jun. 12, 2008.

U.S. Appl. No. 12/137,823 "Method for Recovering Crude Oil from a Subterranean Formation", Futterer et al., filed Jun. 12, 2008.

U.S. Appl. No. 12/138,030 "Detergent Composition with Hydrophilizing Soil-Release Agent and Methods for Using Same" Futterer et al., filed Jun. 12, 2008.

Office Action mailed Oct. 3, 2008 in U.S. Appl. No. 12/138,030.

Office Action mailed Oct. 10, 2008 in U.S. Appl. No. 12/137,823.

Office Action mailed Oct. 3, 2008 in U.S. Appl. No. 12/137,647.

Notice of Allowance mailed Oct. 29, 2008 in U.S. Appl. No. 12/137,589.

* cited by examiner

HARD SURFACE CLEANING COMPOSITION WITH HYDROPHILIZING AGENT AND METHOD FOR CLEANING HARD SURFACES

CROSS REFERENCE TO RELATED APPLICATION

This claims the benefit of U.S. Provisional Patent Application No. 60/943,517 filed Jun. 12, 2007 which is incorporated by reference in its entirety.

FIELD OF THE INVENTION

This invention relates to a hard surface cleaning composition containing a hydrophilizing agent and a method for cleaning hard surfaces, such as ceramic, tiling, metal, melamine, formica, plastic, glass, mirror, and other industrial, kitchen and bathroom surfaces, with a hard surface cleaning composition containing a hydrophilizing agent. More particularly, the present invention employs mono-, di-, and polyol phosphate esters (like PEG phosphate esters, PPG phosphate esters, glycerine phosphate esters) to clean the surface properties of hard surfaces by applying the phosphate esters onto these surfaces. Also, the invention relates to providing long-lasting anti-adhesion and/or anti-deposition properties to hard surfaces.

BACKGROUND OF THE INVENTION

Detergent or cleaning compositions make it possible to clean industrial and domestic hard surfaces. Cleaning compositions generally contain surfactants; solvents, for example alcohol, to possibly facilitate drying; sequestering agents; and bases or acids to adjust the pH. The surfactants are generally nonionic and anionic combinations, or nonionic and cationic combinations. A frequent disadvantage of these cleaning compositions is that the subsequent contact of the hard surface with water leads to the formation of hard water deposits when the surface dries. Moreover, conventional cleaning compositions merely clean the surface, but do little to prevent future soiling.

A solution to this problem was proposed in EP-A-1 196 527, EP-A-1 196 528 and EP-A-1 196 523. These patents propose to deposit on the hard surface a cleaning composition containing a water-soluble amphoteric organic copolymer derived from a cation monomer and an anion or potentially anionic monomer in a sufficient quantity to make the surface absorbent or to improve the hydrophilicity of the surface. This is done to obtain the smallest possible contact angle between the treated surface and a water drop and to ensure the water retention in the vicinity of the treated surface lasts after treatment.

US Patent Application Publication No. 2006/0217286, incorporated herein by reference, discloses compositions for cleaning or rinsing hard surfaces in an aqueous or aqueous/alcoholic medium comprising at least one polybetaine for contributing to the surfaces antideposition and/or antiadhesion properties with regard to soiling substances capable of being deposited on said surfaces.

Many different approaches can be used to change the surface energy (hydrophilicity/hydrophobicity) and thus the adhesion properties of a given material. For example chemical treatments like plasma or ozone for polyethylene and polypropylene surfaces to increase hydrophilicity. Or physico-chemical treatments like the adhesion of surfactant molecules onto hydrophobic surfaces can alter them hydrophilic. Also the adhesion of polymers onto surfaces is used to change surface properties. One specific example would be the adsorption of polyethylene oxide (PEG). In all cases specific chemical groups are attached to the initial surface. These chemical groups change the surface energy and thus the adhesion properties and/or other surface properties like tendency of fouling or slip.

Two of the main disadvantages of the above mentioned treatments are poor durability and/or they are expensive/technically sophisticated. One example of the former is surfactants. They get easily washed away from the surface upon rinsing with e.g. water. An example for the latter is plasma or ozone treatment. Further, for some applications no satisfying solution is found up to date.

Materials that have a low surface energy, such as, for example, polyolefin polymers, have hydrophobic surfaces. The hydrophobic properties of such materials are not desirable in some applications and methods for hydrophilizing low surface energy substrates, including treatment with surfactants and/or high energy treatment, are known. Each of these methods has significant limitations. Surfactant treatments tend to wash off when a treated substrate is exposed to water and the charges imparted to the surface of a treated substrate by high energy treatment tend, particularly in the case of a thermoplastic polymer substrate, to dissipate. The hydrophilic properties of such surfactant treated substrates and high energy treated substrates thus tend to exhibit limited durability. Furthermore, the surfactants that are rinsed off of a treated substrate by exposure to water alter the properties of the water, such as lowering the surface tension, which may also be undesirable.

It would be advantageous to provide a cleaning composition for hard surfaces which imparts improved anti-deposition and/or anti-adhesion properties to a hard surface, particularly anti-soil deposition and anti-soil adhesion properties. It would also be advantageous to provide a cleaning composition for hard surfaces which prevents or minimizes hard water deposits, soap scum, and other mineral deposits. Accordingly, there is a need for more durably hydrophilizing low surface energy hard substrates.

SUMMARY OF THE INVENTION

Figure 1:
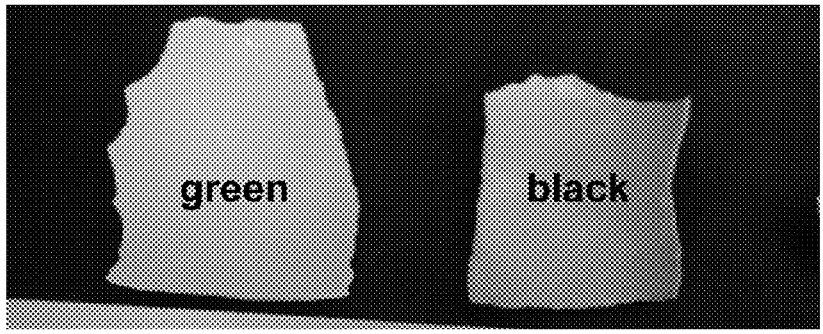
FIG. 1 shows a photograph of egg-shell brushed with commercial toothpaste, then stained with green (left) and black (right) tea, and then brushed again with commercial toothpaste.

In a first aspect, the present invention is directed a composition for the cleaning in an aqueous or aqueous/alcoholic medium of hard surfaces comprising at least one surface-active agent and at least one mono-, di-, and polyol phosphate ester (for example PEG phosphate esters, PPG phosphate esters, glycerine phosphate esters). For purposes of this specification a compositions for cleaning includes compositions for cleaning and compositions for rinsing.

More particularly in this first aspect, the present invention is directed to a hard surface cleaning composition, comprising:

(a) a surface active agent, and (b) a hydrophilizing agent comprising:

(b)(I) an organophosphorus material selected from:

(b)(I)(1) organophosphorus compounds according to structure (I):

(I)

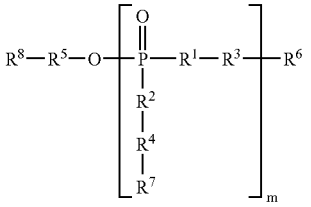

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or ($C_1$-$C_{30}$) hydrocarbon,which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3).

If desired the composition may further comprise:

(b)(II) a vinyl alcohol material selected from:

(b)(I)(1) polymers comprising monomeric units according to structure (I-a):

(I-a)

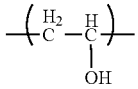

(b)(II)(2) salts of polymers (b)(II)(1), (b)(II)(3) reaction products of two or more molecules of one or more polymers (b)(II)(1), and (b)(II)(4) mixtures comprising two or more of the polymers, salts, and/or reaction products of (b)(II)(1), (b)(II)(2), and (b)(II)(3), and (b)(III) mixtures of one or more organophosphorus materials (b)(I) and one or more vinyl alcohol materials (b)(II).

In a second aspect, the present invention is directed to a method for hydrophilizing a hard surface having a hydrophobic surface, comprising treating at least a portion of such hydrophobic surface with a treatment composition comprising an organophosphorus material, a surface-active agent and optionally a vinyl alcohol, as described above to deposit a hydrophilizing layer on such portion of such hydrophobic surface.

In a third aspect the present invention is directed to a cleaning composition for pre-treating a hard surface of an article. Consistent with this, the present invention is directed to a pre-treated article, comprising:

(a) a hard surface substrate having a hydrophobic surface, and (b) a hydrophilizing layer disposed on at least a portion of the hydrophobic surface of the substrate, the layer comprising:

(b)(I) an organophosphorus material selected from:

(b)(I)(1) organophosphorus compounds according to structure (I):

(I)

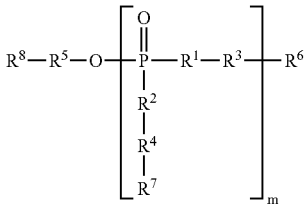

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), (b)(I)(4) mixtures comprising two or more of the compounds, salts, and/or reaction products of (I)(1), (I)(2), and (I)(3).

If desired the layer may further comprise:

(b)(II) a vinyl alcohol material selected from:

(b)(II)(1) polymers comprising monomeric units according to structure (I-a):

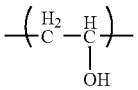

(I-a)

(b)(II)(2) salts of polymers (b)(II)(1), (b)(II)(3) reaction products of two or more molecules of one or more polymers (b)(I)(1), and (b)(II)(4) mixtures comprising two or more of the polymers, salts, and/or reaction products of (b)(I)I(1), (b)(II)(2), and (b)(II)(3), and (b)(III) mixtures of one or more organophosphorus materials (b)(I) and one or more vinyl alcohol materials (b)(II).

The treatment of surfaces with the phosphate esters results in changed surface properties. The reduced adsorption of oil (like octadecane) onto calcium carbonate facilitates the extraction of grease or oil from porous stone materials. Treated facades or statues made from, for example, calcium carbonate stone can be more easily cleaned or show a self-cleaning effect due to a reduced adsorption of soil from rain and the air onto the facade or statue.

The invention has a number of advantages. The phosphate esters are relatively inexpensive and easy to manufacture in comparison to many polymers used for surface treatments. The treatment is easy and fast (usually from aqueous solution), especially compared to, for example, plasma, ozone, or other chemical treatments. The coating is significantly more durable compared to surfactant systems. While not wishing to be limited by theory, it is theorized this is due to a specific binding of the phosphate group onto the surface. For example, surfaces with calcium ions show a durable adsorption of phosphate groups. Further, surfactants can not be used for surfaces which are not sufficiently hydrophobic. The hydrophobic surfactant groups cannot adsorb onto such surfaces. Then, for example, polyethylene glycol (PEG) or polypropylene glycol (PPG) might be used instead of surfactants. But coatings with PEG or PPG are not durable either. Again, the durability of the phosphate esters is significantly improved compared to, e.g., PEG or PPG homopolymers. The phosphate esters are considered non-toxic, non-irritant to skin and biodegradable.

DETAILED DESCRIPTION OF THE INVENTION

In a first aspect, the present invention is directed a composition for the cleaning in a solvent medium for hard surfaces comprising at least one surface-active agent and at least one mono-, di-, and polyol phosphate ester (for example PEG phosphate esters, PPG phosphate esters, glycerine phosphate esters). For purposes of this specification a compositions for cleaning includes compositions for cleaning and compositions for rinsing.

The present invention is directed to a hard surface cleaning composition, comprising:

(a) a surface active agent, and (b) a hydrophilizing agent comprising:

(b)(I) an organophosphorus material selected from:

(b)(I)(1) organophosphorus compounds according to structure (I):

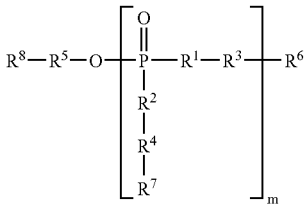

(I)

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3).

If desired the composition may further comprise:

(b)(II) a vinyl alcohol material selected from:

(b)(II)(1) polymers comprising monomeric units according to structure (I-a):

(I-a)

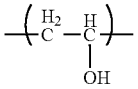

(b)(II)(2) salts of polymers (b)(II)(1), (b)(II)(3) reaction products of two or more molecules of one or more polymers (b)(II)(1), and (b)(II)(4) mixtures comprising two or more of the polymers, salts, and/or reaction products of (b)(II)(1), (b)(II)(2), and (b)(II)(3).

According to the present invention, deposition on a hard surface, via a cleaning formulation, of mono-, di-, and polyol phosphate esters (like PEG phosphate esters, PPG phosphate esters, glycerine phosphate esters) makes it possible to confer, on the surface thus treated, persistent antideposition and/or antiadhesion properties with regard to soiling substances; in addition, the presence of mono-, di-, and polyol phosphate esters (like PEG phosphate esters, PPG phosphate esters, glycerine phosphate esters) makes it possible to improve the cleaning ability of the formulation.

Use of mono-, di-, and polyol phosphate esters (like PEG phosphate esters, PPG phosphate esters, glycerine phosphate esters) changes the surface properties of several surfaces by adsorption of the phosphate esters onto these surfaces. The treatment of the surfaces in most cases is simply by adsorption from aqueous solutions. For example, the treatment of calcium carbonate crystal is done by immersing the crystal in an aqueous solution of e.g. PEG400 phosphate ester (e.g. 1 wt %, pH 6-7). A successful adsorption onto the crystal and a respective change of the surface properties is shown by measuring the contact angle of octadecane droplets under water. A low contact angle is observed for the untreated crystal (i.e. good adsorption of the oil onto the crystal) and a high contact angle is observed for the treated crystal (i.e. poor adsorption of the oil onto the crystal).

As used herein, the terminology "hydrophobic surface" means a surface that exhibits a tendency to repel water and to thus resist being wetted by water, as evidenced by a water contact angle of greater than or equal to 70°, more typically greater than or equal to 90°, and/or a surface free energy of less than or equal to about 40 dynes/cm.

As used herein, the terminology "hydrophilic surface" means a surface that exhibits an affinity for water and to thus be wettable by water, as evidenced by a water contact angle of less than 70°, more typically less than 60° and/or a surface energy of greater than about 40 dynes/cm, more typically greater than or equal to about 50 dynes/cm.

As used herein in reference to a hydrophobic surface, the term "hydrophilizing" means rendering such surface more hydrophilic and thus less hydrophobic, as indicated by a decreased water contact angle. One indication of increased hydrophilicity of a treated hydrophobic surface is a decreased water contact angle with a treated surface compared to the water contact angle with an untreated surface.

As used herein in reference to a substrate, the terminology "water contact angle" means the contact angle exhibited by a droplet of water on the surface as measured by a conventional image analysis method, that is, by disposing a droplet of water on the surface, typically a substantially flat surface, at 25° C., photographing the droplet, and measuring the contact angle shown in the photographic image.

Surface energy is estimated using the Young equation:

$$\cos(\theta)^{*}\gamma_{lv}=\gamma_{sv}-\gamma_{sl}$$

with the contact angle θ, the interfacial energy $y_{sv}$ between the solid and the vapor phase, the interfacial energy $\gamma_{sl}$ between the solid and the liquid phase, and the interfacial energy $\gamma_{lv}$ between the liquid and the vapor phase, and $\gamma_{sv}$ represents the surface energy of the solid.

As used herein, "molecular weight" in reference to a polymer or any portion thereof, means to the weight-average molecular weight ("$M_w$") of the polymer or portion, wherein $M_w$ of a polymer is a value measured by gel permeation chromatography and $M_w$ of a portion of a polymer is a value calculated according to known techniques from the amounts of monomers, polymers, initiators and/or transfer agents used to make the said portion.

As used herein, the notation "($C_n$-$C_m$)" in reference to an organic group or compound, wherein n and m are integers, means that the group or compound contains from n to m carbon atoms per such group or compound.

The term "persistent antideposition and/or antiadhesion properties" is understood to mean that the treated surface retains these properties over time, including after subsequent contacts with a soiling substance (for example rainwater, water from the distribution network, rinsing water to which rinsing products have or have not been added, spattered fats, soaps, and the like). This property of persistence can be observed beyond approximately 10 rinsing cycles, indeed even, in some specific cases where numerous rinsings are carried out (case of toilets, for example), beyond 100 rinsing cycles.

The expression of "conferring, on the surface thus treated, antideposition properties" means more particularly that the treated surface, brought into contact with a soiling substance in a predominantly aqueous medium, will not have a tendency to "capture" said soiling substance, which thus significantly reduces the deposition of the soiling substance on the surface.

The expression of "conferring, on the surface thus treated, antiadhesion properties" means more particularly that the treated surface is capable of interacting only very slightly with the soiling substance which has been deposited thereon, which makes possible easy removal of the soiling substances from the soiled treated surface; this is because, during the drying of the soiling substance brought into contact with the treated surface, the bonds developed between the soiling substance and the surface are very weak; thus, to break these bonds requires less energy (thus less effort) during the cleaning operation.

When it is said that the presence of mono-, di-, and polyol phosphate esters (like PEG phosphate esters, PPG phosphate esters, glycerine phosphate esters) makes it possible "to improve the cleaning ability" of a formulation, this means that, for the same amount of cleaning formulation (in particular a formulation for washing dishes by hand), the formulation comprising polybetaine zwitterions makes it possible to clean a greater number of soiled objects than a formulation which is devoid thereof.

In addition, the deposition on a hard surface of mono-, di-, and polyol phosphate esters (like PEG phosphate esters, PPG phosphate esters, glycerine phosphate esters) makes it possible to contribute antistatic properties to this surface; this property is particularly advantageous in the case of synthetic surfaces.

The presence of mono-, di-, and polyol phosphate esters (like PEG phosphate esters, PPG phosphate esters, glycerine phosphate esters) in formulations for the treatment of a hard surface makes it possible to render the surface hydrophilic or to improve its hydrophilicity.

The property of hydrophilization of the surface makes it possible in addition to reduce the formation of condensation on the surface; this advantage can be made use of in cleaning formulations for windows and mirrors, in particular in bathrooms. Furthermore, the rate of drying of the surface, immediately after treatment thereof by the application of the polymer but also after subsequent and repeated contacts with an aqueous medium, is very significantly improved.

The term "hard surfaces" is to be taken in the broad sense; it refers to nontextile surfaces which can equally well be domestic, communal or industrial surfaces.

They can be made of any material, in particular of the following types:

- ceramic (surfaces such as bathroom sinks, bath tubs, wall or floor tiles, toilet bowls and the like),
- glass (surface such as interior or exterior windows of buildings or of vehicles, or mirrors,
- metal (surfaces such as internal or external walls of reactors, blades, panels, pipes, and the like),
- synthetic resins (for example bodywork or interior surfaces of motorized vehicles (automobiles, trucks, buses, trains, planes, and the like), melamine or formica surfaces for the interior of offices, kitchens, and the like),
- plastics (for example poly(vinyl chloride) or polyamide, for the interior of vehicles, in particular automobiles).

The "hard surfaces" according to the invention are surfaces which are not very porous and which are non-fibrillate; they are thus to be distinguished from textile surfaces (fabrics, fitted carpets, clothes, and the like, made of natural, artificial or synthetic materials).

The composition according to the invention, capable of contributing, to the hard surfaces to be treated, antideposition and/or antiadhesion properties with regard to soiling substances, can be a cleaning (or rinsing) composition for domestic use.

It can be universal or can be more specific, such as a composition for cleaning or rinsing any of the following:

- the bathroom; the composition prevents in particular deposition of soap salts around bath tubs and on bathroom sinks, prevents the growth and/or the deposition of calcium crystals on these surfaces, and delays the appearance of subsequent soap stains;
- the kitchen; the composition makes it possible to improve the cleaning of worktops when the latter are soiled by unsaturated fatty soiling substances capable of crosslinking over time; the greasy stains come off with water without rubbing;
- floors (made of linoleum, tiling or cement); the composition makes it possible to improve the removal of dust or soiling substances of argilocalcareous types (soil, sand, mud, and the like); stains on the floor can be cleaned without effort by simple sweeping, without brushing; in addition, the composition contributes slip-resistance properties;
- toilet bowls; the composition makes it possible to prevent the adhesion of traces of excrement to the surface; the flow alone of the flush of water is sufficient to remove these traces; the use of a brush is unnecessary;
- glass, transparent polymers, e.g., polycarbonate, windows or mirrors; the composition makes it possible to prevent the deposition of inorganic or organic particulate soiling substances on the surface;
- dishes, by hand or using an automatic device (e.g., automatic dishwashing machine); the composition makes it possible, in the case of washing by hand, to facilitate the removal of the residual stains from dried foods and to wash a larger number of items of cutlery or utensils with the same volume of washing medium; the surface of the still wet items of cutlery and utensils is no longer slippery and thus does not escape from the hands of the user; a squeaky clean effect has also been observed, namely that the surface "squeaks" under the effect of rubbing with the finger. In the case of washing or rinsing in a dishwasher, the composition makes possible the antiredeposition of soiling substances originating from foodstuffs and of insoluble inorganic calcium salts, and contributes shininess to the utensils and items of cutlery; the composition also makes it possible no longer to have to "prewash" the items of cutlery or utensils before they are introduced into the dishwasher.

A cleaning (or rinsing) composition for industrial or communal use; it can be universal or more specific, such as a composition for cleaning any of the following:

- reactors, steel blades, sinks or tanks,
- dishes,
- exterior or interior surfaces of buildings,
- windows of buildings, including apartment buildings,
- bottles.

The composition according to the invention can be provided in any form and can be used in multiple ways.

Thus, it can be in the form of a gelled or ungelled liquid to be deposited as such, in particular by spraying,

- directly on the surfaces to be cleaned or rinsed, or
- on a sponge or another substrate (woven or nonwoven article made of cellulose, for example) before being applied to the surface to be treated.

It can be in the form of:

- a gelled or ungelled liquid to be diluted in water (optionally with the addition of another solvent) before being applied to the surface to be treated;
- a gelled or ungelled liquid held in a water-soluble bag.
- a foam,
- an aerosol,
- a liquid absorbed on an absorbent substrate made of an article which is woven or nonwoven in particular (wipe),
- a solid, in particular a tablet, optionally held in a water-soluble bag, it being possible for the composition to represent all or part of the tablet.

For satisfactory implementation of the invention, the phosphate ester is present in the composition forming the subject matter of the invention in an amount which is effective in contributing, to the surfaces, antideposition and/or antiadhesion properties with regard to soiling substances capable of being deposited on the surfaces.

The composition forming the subject matter of the invention can comprise, depending on its application, from 0.001 to 10% of its weight of at least one of the phosphate esters.

The pH of the composition or the pH of use of the composition according to the invention can vary, depending on the applications and the surfaces to be treated, from 1 to 14, indeed even from 0.5 to 14.

Extreme pH values are conventional in the applications of industrial or communal cleaning type. In the field of domestic applications, the pH values range instead from 1 to 13, depending on the applications.

The composition can be employed for the cleaning or rinsing of hard surfaces in an amount such that, after optional rinsing and after drying, the amount of phosphate esters deposited on the surface is typically from 0.0001 to 10 $mg/m^2$, for example, 0.001 to 5 $mg/m^2$, of surface treated.

Unless otherwise indicated, when molar mass is referred to, the reference will be to the weight-average molar mass, expressed in g/mol. The latter can be determined by aqueous gel permeation chromatography (GPC) or by light scattering (DLS or alternatively MALLS), with an aqueous eluent or an organic eluent (for example dimethylacetamide, dimethylformamide, and the like), depending on the composition of the polymer.

In a second aspect, the present invention is directed to a method for hydrophilizing a hard surface having a hydrophobic surface, comprising treating at least a portion of the hydrophobic surface with a treatment composition comprising a surface-active agent, an organophosphorus material, and an optional vinyl alcohol material, as described above to deposit a hydrophilizing layer on the portion of the hydrophobic surface.

In a third aspect the present invention is directed to a cleaning composition for pre-treating a hard surface of an article with the above-described organophosphorus material.

Consistent with this, the present invention is also directed to a pre-treated article, comprising:

(a) a hard surface substrate having a hydrophobic surface, and (b) a hydrophilizing layer disposed on at least a portion of the hydrophobic surface of the substrate, the layer comprising:

(b)(I) the above-described organophosphorus material

If desired the layer may further comprise the above-described vinyl alcohol material and/or a surface-active agent.

Hydrophobic Hard Surface Substrate

The composition of the present invention is useful on hard surfaces. Hard surfaces are described above, for example, ceramic, porcelain, glass, metal, synthetic resins, and plastics. The "hard surfaces" according to the invention are surfaces which are not very porous and which are non-fibrillate; they are thus to be distinguished from textile surfaces (fabrics, fitted carpets, clothes, and the like, made of natural, artificial or synthetic materials).

In some instances the hard surface substrate having a hydrophobic surface. Suitable hydrophobic materials comprise, for example, hydrophobic ally modified inorganic materials, e.g., glass, porcelain, ceramic, tiles, silanized glass and silica, graphite, granite, stone, building facades, metal, and polymers.

Phosphate Esters (Organophosphorus Compounds)

As used herein, the term "alkyl" means a monovalent saturated straight chain or branched hydrocarbon radical, typically a monovalent saturated ($C_1$-$C_{30}$)hydrocarbon radical, such as for example, methyl, ethyl, n-propyl, iso-propyl, n-butyl, sec-butyl, t-butyl, pentyl, or n-hexyl, which may optionally be substituted on one or more of the carbon atoms of the radical. In one embodiment, an alkyl radical is substituted on one or more carbon atoms of the radical with alkoxy, amino, halo, carboxy, or phosphono, such as, for example, hydroxymethyl hydroxyethyl, methoxymethyl, ethoxymethyl, isopropoxyethyl, aminomethyl, chloromethyl or trichloromethyl, carboxyethyl, or phosphonomethyl.

As used herein, the term "hydroxyalkyl" means an alkyl radical that is substituted on one of its carbon atoms with a hydroxyl group.

As used herein, the term "alkoxyl" means an oxy radical that is substituted with an alkyl group, such as for example, methoxyl, ethoxyl, propoxyl, isopropoxyl, or butoxyl, which may optionally be further substituted on one or more of the carbon atoms of the radical.

As used herein, the term "cylcoalkyl" means a saturated cyclic hydrocarbon radical, typically a ($C_3$-$C_8$) saturated cyclic hydrocarbon radical, such as, for example, cyclohexyl or cyclooctyl, which may optionally be substituted on one or more of the carbon atoms of the radical.

As used herein, the term "alkenyl" means an unsaturated straight chain, branched chain, or cyclic hydrocarbon radical that contains one or more carbon-carbon double bonds, such as, for example, ethenyl, 1 -propenyl, or 2-propenyl, which may optionally be substituted on one or more of the carbon atoms of the radical.

As used herein, the term "aryl" means a monovalent unsaturated hydrocarbon radical containing one or more six-membered carbon rings in which the unsaturation may be represented by three conjugated double bonds, such as for example, phenyl, naphthyl, anthryl, phenanthryl, or biphenyl, which may optionally be substituted one or more of carbons of the ring. In one embodiment, an aryl radical is substituted on one or more carbon atoms of the radical with hydroxyl, alkenyl, halo, haloalkyl, or amino, such as, for example, methylphenyl, dimethylphenyl, hydroxyphenyl, chlorophenyl, trichloromethylphenyl, or aminophenyl.

As used herein, the term "aryloxy" means an oxy radical that is substituted with an aryl group, such as for example, phenyloxy, methylphenyl oxy, isopropylmethylphenyloxy. In the present application, average molecular weights are weight average molecular weights unless otherwise specified.

As used herein, the indication that a radical may be "optionally substituted" or "optionally further substituted" means, in general, that is unless further limited, either explicitly or by the context of such reference, that such radical may be substituted with one or more inorganic or organic substituent groups, such as, for example, alkyl, alkenyl, aryl, aralkyl, alkaryl, a hetero atom, or heterocyclyl, or with one or more functional groups that are capable of coordinating to metal ions, such as hydroxyl, carbonyl, carboxyl, amino, imino, amido, phosphonic acid, sulphonic acid, or arsenate, or inorganic and organic esters thereof, such as, for example, sulphate or phosphate, or salts thereof.

As used herein, the terminology "($C_x$-$C_y$)" in reference to an organic group, wherein x and y are each integers, indicates that the group may contain from x carbon atoms to y carbon atoms per group.

As described above, the water-soluble or dispersibe organophosphorus material for use in the hard surface cleaning composition according to the present invention comprises a hydrophilizing agent comprising:

(c)(I) an organophosphorus material selected from:

(c)(I)(1) organophosphorus compounds according to structure (I):

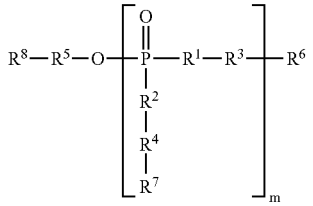

(I)

wherein:

each $R^1$ is and each $R^2$ is independently absent or O, provided that at least one of $R^1$ and $R^2$ is O, each $R^3$ is independently alkyleneoxy, poly(alkyleneoxy), which may optionally, be substituted on one or more carbon atom of such alkyleneoxy, or poly (alkyleneoxy) group by hydroxyl, alkyl, hydroxyalkyl, alkoxy, alkenyl, aryl, or aryloxy, $R^5$ is and each $R^4$ is independently absent or alkyleneoxy, poly(alkyleneoxy), which may optionally, be substituted on one or more carbon atom of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, $R^9$ and $R^{10}$ are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (c)(I)(2) salts of organophosphorus compounds according to structure (I), (c)(I)(3) condensation reaction products of two or more molecules of one or more organophosphorus compounds according to structure (I), and (c)(I)(4) mixtures comprising two or more of the compounds, salts, and/or reaction products of (b)(I)(1), (b)(I)(2), and (b)(I)(3).

Organophosphorus material suitable for use in the present hard surface cleaner composition are also described in U.S. provisional patent application Nos. 60/842,265, filed Sep. 5, 2006 and 60/812,819, filed Jun. 12, 2006, both incorporated herein by reference.

In one embodiment, $R^6$ and $R^8$ are each and each $R^7$ is independently H, ($C_1$-$C_{30}$) alkyl, ($C_1$-$C_{30}$) alkenyl, or ($C_7$-$C_{30}$) alkaryl.

In one embodiment, each $R^1$ and each $R^2$ is O, and the organophosphorus compound is selected from:

(II)(1) an organophosphate ester according to structure (II):

(II)

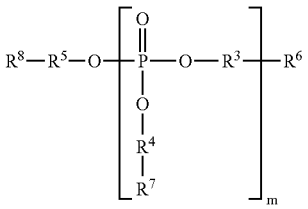

wherein $R^3$, $R^4$, $R^5$, $R^6$, $R^7$, $R^8$, and m are each as described above, (II)(2) salts of organophosphorus compounds according to structure (II), (II)(3) condensation reaction products of two or more molecules of one or more organophosphorus compounds according to structure (II), and (II)(4) mixtures comprising two or more of the compounds, salts, and/or reaction products of (II)(1), (II)(2), and (II)(3).

In one embodiment, each $R^1$ is absent, each $R^2$ is O, and the organophosphorus compound is selected from:

(III)(1) an organophosphonate ester according to structure (III):

(III)

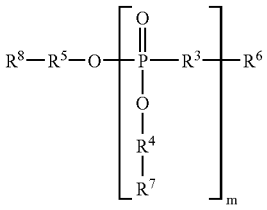

wherein $R^3$, $R^4$, $R^5$, $R^6$, $R^7$, $R^8$, and m are each as described above, (III)(2) salts of organophosphorus compounds according to structure (III), (III)(3) condensation reaction products of two or more molecules of one or more organophosphorus compounds according to structure (III), and (III)(4) mixtures comprising two or more of the compounds, salts, and/or reaction products of (III)(1), (III)(2), and (III)(3).

In one embodiment, each $R^1$ is O, each $R^2$ is absent, and the organophosphorus compound is selected from:

(IV)(1) an organophosphonate ester according to structure (IV):

(IV)

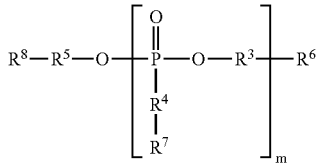

wherein $R^3$, $R^4$, $R^5$, $R^6$, $R^7$, $R^8$, and m are each as described above, (IV)(2) salts of organophosphorus compounds according to structure (IV), (IV)(3) condensation reaction products of two or more molecules of one or more organophosphorus compounds according to structure (IV), and (IV)(4) mixtures comprising two or more of the compounds, salts, and/or reaction products of (IV)(1), (IV)(2), and (IV)(3).

In one embodiment, each $R^3$ is a divalent radical according to structure (V), (VI), (VII), or (VIII):

(V)

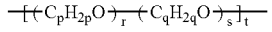

(VI)

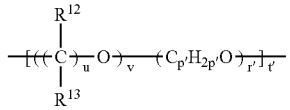

(VII)

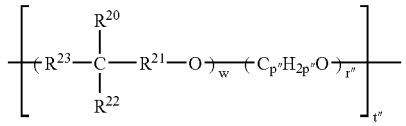

(VIII)

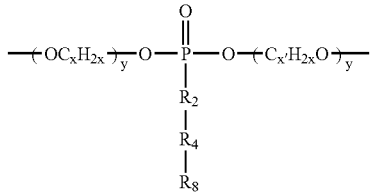

wherein:

each $R^{12}$ and each $R^{13}$ is independently H, hydroxyl, alkyl hydroxyalkyl, alkoxy, alkenyl, aryl, aryloxy, or two $R^{12}$ groups that are attached to the adjacent carbon atoms may be fused to form, together with the carbon atoms to which they are attached, a ($C_6$-$C_8$) hydrocarbon ring, $R^{20}$ is H, hydroxyl, alkyl, hydroxyalkyl, alkoxy, alkenyl, aryl, or aryloxy $R^{22}$ is hydroxyl or hydroxyalkyl, provided that $R^{20}$ and $R^{22}$ are not each hydroxyl, $R^{23}$ and $R^{21}$ are each independently methylene or poly (methylene), p, p', p", q, and x are each independently integers of from 2 to 5, each r, s, r', r", and y is independently a number of from 0 to 25, provided that at least one of r and s is not 0, u is an integer of from 2 to 10, v and w are each numbers of from 1 to 25, and t, t', and t" are each numbers of from 1 to 25, provided that the product of the quantity (r+s) multiplied times t is less than or equal to about 100, the product of the quantity (v+r') multiplied times t' is less than or equal to about 100, and the product of the quantity (w+r") multiplied time t" is less than or equal to about 100.

In one embodiment, each $R^4$ and each $R^5$ is independently absent or a divalent radical according to structure (V), (VI), or (VII), wherein $R^{12}$, $R^{13}$, $R^{20}$, $R^{21}$, $R^{22}$, $R^{23}$, p, p', p", q, r, r', r", s, t, t", t, u, v, w, x, and y are as described above.

In one embodiment, each $R^3$ is independently a divalent radical according to structure (V), (VI), or (VII) wherein $R^{12}$, $R^{13}$, $R^{20}$, $R^{21}$, $R^{22}$, $R^{23}$, p, p', p", q, r, r', r", s, t, t", t, u, v, w, x, and y are as described above, and $R^4$ and $R^5$ are each independently absent or $R^3$.

In one embodiment, each $R^3$ is independently a divalent radical according to structure (V), wherein p is 2, 3, or 4, r is an integer from 1 to 25, s is 0, t is an integer of from 1 to 2, and $R^4$ and $R^5$ are each independently absent or $R^3$.

In one embodiment, each $R^3$ is independently a divalent radical according to structure (VI), wherein the $R^{12}$ groups are fused to form, including the carbon atoms to which they are attached, a ($C_6$-$C_8$) hydrocarbon ring, each $R^{13}$ is H, p' is 2 or 3, u is 2, v is an integer of from 1 to 3, r' is an integer from 1 to 25, t' is an integer of from 1 to 25, the product of the quantity (v+r') multiplied times t" is less than or equal to about 100, more typically less than or equal to about 50, and $R^4$ and $R^5$ are each independently absent or $R^3$.

In one embodiment, each $R^3$ is independently a divalent radical according to structure (VII), wherein $R^{20}$ is hydroxyl or hydroxyalkyl, $R^{22}$ is H, alkyl, hydroxyl, or hydroxyalkyl, provided that $R^{20}$ and $R^{22}$ are not each hydroxyl, $R^{21}$ and $R^{23}$ are each independently methylene, di(methylene), or tri(methylene), w is 1 or 2, p" is 2 or 3, r" is an integer of from 1 to 25, t" is an integer of from 1 to 25, the product of the quantity (w+r") multiplied times t" is less than or equal to about 100, more typically less than or equal to about 50, and $R^4$ and $R^5$ are each independently absent or $R^3$.

In one embodiment of the organophosphorus compound according to structure (II), $R^6$ and $R^8$ are each and each $R^7$ is independently H or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, or —$POR^9R^{10}$, more typically, $R^6$, $R^8$, and each $R^7$ are each H, $R^4$ and $R^5$ are each absent, each $R^3$ is independently a divalent radical according to structure (V), (VI), or (VII), and m is an integer of from 1 to 5.

In one embodiment of the organophosphorus compound according to structure (II):

$R^6$, $R^8$, and each $R^7$ are each H $R^4$ and $R^5$ are each absent, each $R^3$ is independently a divalent radical according to structure (V), each p is independently 2, 3,or 4, more typically 2 or 3, each r is independently a number of from 1 to about 100, more typically from 2 to about 50, each s is 0, each t is 1, and m is an integer of from 1 to 5.

In one embodiment, the organophosphorus material is selected from:

(X)(1) organophosphorus compounds according to structure (IX):

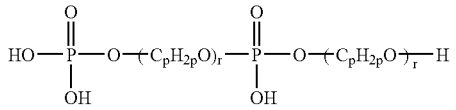

(IX)

wherein:

p is 2, 3, or 4, more typically 2 or 3, r is a number of from 4 to about 50, (IX)(2) salts organophosphorus compounds according to structure (IX), and (IX)(3) mixtures comprising two or more of the compounds and/or salts of (IX)(1) and (IX)(2).

In one embodiment of the organophosphorus compound according to structure (II):

$R^6$, $R^8$, and each $R^7$ are each H $R^4$ and $R^5$ are each absent, each $R^3$ is independently a divalent radical according to structure (VI), the $R^{12}$ groups are fused to form, including the carbon atoms to which they are attached, a ($C_6$-$C_8$)hydrocarbon ring, each $R^{13}$ is H p' is 2 or 3, u is 2, v is 1, r' is a number of from 1 to 25, t' is a number of from 1 to 25, the product of the quantity (v+r') multiplied times t' is less than or equal to about 100, and m is an integer of from 1 to 5.

In one embodiment of the organophosphorus compound according to structure (II):

$R^6$, $R^8$, and each $R^7$ are each H, $R^4$ and $R^5$ are each absent, each $R^3$ is independently a divalent radical according to structure (VII), $R^{20}$ is hydroxyl or hydroxyalkyl, $R^{22}$ is H, alkyl, hydroxyl, or hydroxyalkyl, $R^{23}$ and $R^{21}$ are each independently methylene, di(methylene), or tri(methylene), w is 1 or 2, p" is 2 or 3, r" is a number of from 1 to 25, t" is a number of from 1 to 25 the product of the quantity (w+r") multiplied times t" is less than or equal to about 100, and m is an integer of from 1 to 5.

In one embodiment, the organophosphorus compound is according to structure (III), each $R^3$ is a divalent radical according to structure (V) with s=0 and t=1, $R^4$ and $R^5$ are each absent, and $R^6$, $R^7$, and $R^8$ are each H.

In one embodiment, the organophosphorus compound is according to structure (IV), wherein R3 and R5 are each according to structure (V), with s=0 and t=1, and $R^6$ and $R^8$ are each H.

In one embodiment, the organophosphorus material (b)(I) comprises a condensation reaction product of two or more molecules according to structure (I).

In one embodiment, the organophosphorus material (b)(I) comprises a condensation reaction product of two or more molecules according to structure (I) in the form of a linear molecule, such as, for example, a linear condensation reaction product according to structure (X), formed by condensation of a molecule according to structure (II) with a molecule according to structure (IV):

(X)

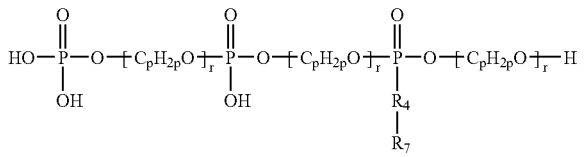

wherein $R^4$, $R^7$, p, r are each as described above.

In one embodiment, the organophosphorus material (b)(I) comprises a condensation reaction product of two or more molecules according to structure (I) in the form of a crosslinked network. A portion of an exemplary crosslinked condensation reaction product network is illustrated by structure (XI):

(XI)

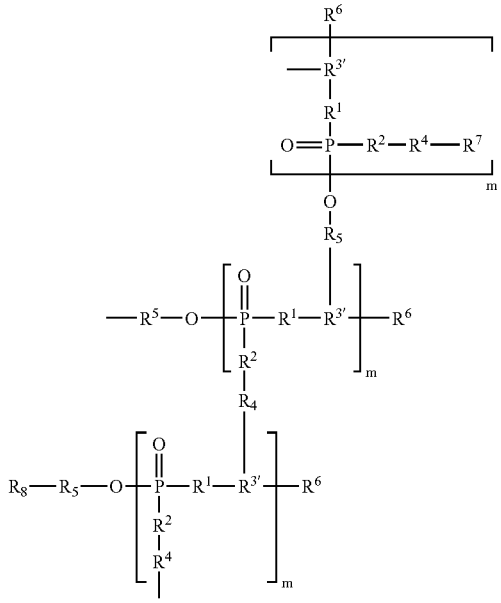

wherein $R^1$, $R^2$, $R^4$, $R^5$, $R^6$, $R^7$, $R^8$, and m are each as described above, and each $R^3$ is independently a residue of an $R^3$ group of a compound according to structure (I), as described above, wherein the $R^3$ group is a alkyleneoxy or poly(alkyleneoxy) moiety substituted with hydroxyl-, hydroxyalkyl-, hydroxyalkyleneoxy- or hydroxypoly(alkyleneoxy)- on one or more carbon atoms of the alkyleneoxy or poly(alkyleneoxy) moiety, and —$R^3$-$R_4$— and —$R^{3'}$-$R^5$— each represent a respective linkage formed by condensation of such an $R^3$ group and a —$R^{3'}$-$R^5$— or $R^8$-$R^5$— group of molecules of another molecule of a compound according to structure (I).

In one embodiment, the organophosphorus material (b)(I) comprises a condensation reaction product of two or more molecules according to structure (I) and the condensation reaction product forms a covalently crosslinked organophosphorus network. Typically the solubility of the covalently crosslinked organophosphorus network in water is less than that of the organophosphorus compound according to structure (I), more typically, the covalently crosslinked organophosphorus network is substantially insoluble in water.

As used herein, the term "salts" refers to salts prepared from bases or acids including inorganic or organic bases and inorganic or organic acids.

In one embodiment, the organophosporus material (b)(I) is in the form of a salt that comprises an anion derived (for example, by deprotonation of a hydroxyl or a hydroxyalkyl substituent) from of an organophosphorus compound according to structure (I) and one or more positively charged counterions derived from a base.

Suitable positively charged counterions include inorganic cations and organic cations, such as for example, sodium cations, potassium cations, calcium cations, magnesium cations, copper cations, zinc cations, ammonium cations, tetraalkylammonium cations, as well as cations derived from primary, secondary, and tertiary amines, and substituted amines.

In one embodiment, the cation is a monovalent cation, such as for example, $Na^+$, or $K^+$.

In one embodiment, the cation is a polyvalent cation, such as, for example, $Ca^{+2}$, $Mg^{+2}$, $Zn^{+2}$, $Mn^{+2}$, $Cu^{+2}$, $Al^{+3}$, $Fe^{+2}$, $Fe^{+3}$, $Ti^{+4}$, $Zr^{+4}$, in which case the organophosporus compound may be in the form of a "salt complex" formed by the organophosphorus compound and the polyvalent cation. For organophosphorus compound having two or more anionic sites, e.g., deprotonated hydroxyl substituents, per molecule, the organophosphorus compound-polyvalent cation complex can develop an ionically crosslinked network structure. Typically the solubility of the ionically crosslinked organophosphorus network in water is less than that of the organophosphorus compound according to structure (I), more typically, the ionically crosslinked organophosphorus network is substantially insoluble in water.

Suitable organophosphorus compounds can be made by known synthetic methods, such as by reaction of one or more compounds, each having two or more hydroxyl groups per molecule, with phosphoric acid, polyphosphoric acid, and or phosphoric anhydride, such as disclosed, for example, in U.S. Pat. Nos. 5,550,274, 5,554,781, and 6,136,221.

In one embodiment, cations are immobilized on a water insoluble substrate to form a water insoluble cationic particle and the hydophilizing layer further comprises cationic particles. Suitable substrates include inorganic oxide particles, including for example, oxides of single elements, such as cerium oxide, titanium oxide, zirconium oxide, halfnium oxide, tantalum oxide, tungsten oxide, silicon dioxide, and bismuth oxide, zinc oxide, indium oxide, and tin oxide, and mixtures of such oxides, as well as oxides of mixtures of such elements, such as cerium-zirconium oxides. Such particle may exhibit a mean particle diameter ("$D_{50}$") of from about 1 nanometer ("nm") to about 50 micrometers ("μm"), more typically from about 5 to about 1000 nm, even more typically from about 10 to about 800 nm, and still more typically from about 20 to about 500 nm, as determined by dynamic light scattering or optical microscopy. In one embodiment, aluminum cations are immobilized on silica particles.

Vinyl Alcohol Material

In one embodiment, the hard surface cleaner, and the hydrophilizing layer, further comprises the above-disclosed vinyl alcohol material (b)(II). In one embodiment, which offers improved solubility in water and improved processability, the vinyl alcohol material (b)(II) comprises a polymer that comprises monomeric units according to structure (I-a) (a "vinyl alcohol polymer").

In one embodiment, the vinyl alcohol polymer exhibits a weight average molecular weight of greater than or equal to about 10,000, more typically from about 10,000 to about 100,000, even more typically from about 10,000 to about 30,000. In an alternative embodiment, which offers improved durability, the vinyl alcohol polymer a weight average molecular weight of greater than or equal to about 100,000, more typically form about 100,000 to about 200,000.

In another embodiment, which offers a balance between processability and durability, the vinyl alcohol polymer exhibits a weight average molecular weight of greater than or equal to about 50,000, more typically from about 50,000 to about 150,000, even more typically from about 80,000 to about 120,000.

In one embodiment, the vinyl alcohol polymer is made by polymerizing a vinyl ester monomer, such as for example, vinyl acetate, to form a polymer, such as a poly(vinyl acetate) homopolymer or a copolymer comprising monomeric units derived from vinyl acetate, having a hydrocarbon backbone and ester substituent groups, and then hydrolyzing at least a portion of the ester substitutent groups of the polymer to form hydroxy-substituted monomeric units according to structure (I-a). In one embodiment, which offers improved solubility in water and improved processability, the vinyl alcohol polymer exhibits a degree of hydrolysis of greater than or equal to about 88%, more typically from about 88% to about 95%. As used herein in reference to a vinyl alcohol polymer that is made by hydrolyzing a polymer initially having a hydrocarbon backbone and ester substituent groups, the term "degree of hydrolysis" means the relative amount, expressed as a percentage, of vinyl ester-substituted monomeric units that were hydrolyzed to form hydroxy-substituted monomeric units. In another embodiment, which offers improved solubility in water and improved durability, the vinyl alcohol polymer exhibits a degree of hydrolysis of greater than or equal to about 99%. In yet another embodiment, which offers a compromise between solubility in water and durability, the polymer exhibits a degree of hydrolysis from about 92 to about 99%.

In one embodiment, the vinyl alcohol polymer has a linear polymeric structure. In an alternative embodiment, the vinyl alcohol polymer has a branched polymeric structure.

In one embodiment, the vinyl alcohol polymer is a vinyl alcohol homopolymer that consists solely of monomeric units according to structure (I-a).

In one embodiment, the vinyl alcohol polymer is a vinyl alcohol copolymer that comprises monomeric units having a structure according to structure (I-a) and further comprises comonomeric units having a structure other than structure (I-a). In one embodiment, the vinyl alcohol polymer is a copolymer that comprises hydroxy-substituted monomeric units according to (I-a) and ester substituted monomeric units and is made by incomplete hydrolysis of a vinyl ester homopolymer.

In one embodiment a vinyl alcohol copolymer comprises greater than or equal to about 50 mole % ("mol %"), more typically greater or equal to than about 80 mol %, monomeric units according to structure (I-a) and less than about 50 mol %, more typically less than about 20 mol %, comonomeric units having a structure other than structure (I-a).

As described above, vinyl alcohol polymers having monomeric units according to structure (I-a) are typically derived from polymerization of vinyl ester monomers and subsequent hydrolysis of vinyl ester-substituted monomeric units of the polymer. Suitable vinyl alcohol copolymers are typically derived by copolymerization of the vinyl ester monomer with any ethylenically unsaturated monomer that is copolymerizable with the vinyl ester monomer, including for example, other vinyl monomers, allyl monomers, acrylic acid, methacrylic acid, acrylic ester monomers, methacrylic ester monomers, acrylamide monomers, and subsequent hydrolysis of at least a portion of the ester-substituted monomeric units to form hydroxy-substituted monomeric units according to structure (I-a).

In one embodiment, the vinyl alcohol polymer comprises monomeric units according to structure (I-a) and further comprises hydrophilic monomeric units other than the monomeric according to structure (I-a). As used herein, the term "hydrophilic monomeric units" are those wherein homopolymers of such monomeric units are soluble in water at 25° C. at a concentration of 1 wt % homopolymer, and include, for example, monomeric units derived from, for example, hydroxy($C_1$-$C_4$)alkyl (meth)acrylates, (meth)acrylamide, ($C_1$-$C_4$)alkyl (meth)acrylamides, N,N-dialkyl-acrylamides, alkoxylated (meth)acrylates, poly(ethylene glycol)-mono methacrylates and poly(ethyleneglycol)-monomethylether methacrylates, hydroxy($C_1$-$C_4$)acrylamides and methacrylamides, hydroxyl($C_1$-$C_4$)alkyl vinyl ethers, N-vinylpyrrole, N-vinyl-2-pyrrolidone, 2- and 4-vinylpyridine, ethylenically unsaturated carboxylic acids having a total of 3 to 5 carbon atoms, amino($C_1$-$C_4$)alkyl, mono($C_1$-$C_4$)alkylamino($C_1$-$C_4$)alkyl, and di($C_1$-$C_4$)alkylamino($C_1$-$C_4$)alkyl (meth)acrylates, allyl alcohol, dimethylaminoethyl methacrylate, dimethylaminoethylmethacrylamide.

In one embodiment, the vinyl alcohol polymer comprises monomeric units according to structure (I-a) and further comprises hydrophobic monomeric units. As used herein, the term "hydrophobic monomeric units" are those wherein homopolymers of such monomeric units are insoluble in water at 25° C. at a concentration of 1 wt % homopolymer, and include, for example, monomeric units derived from ($C_1$-$C_{18}$)alkyl and ($C_5$-$C_{18}$)cycloalkyl (meth)acrylates, ($C_5$-$C_{18}$)alkyl(meth)acrylamides, (meth)acrylonitrile, vinyl ($C_1$-$C_{18}$)alkyanoates, ($C_2$-$C_{18}$)alkenes, ($C_2$-$C_{18}$)haloalkenes, styrene, ($C^1$-$C_6$)alkylstyrenes, ($C_4$-$C_{12}$)alkyl vinyl ethers, fluorinated ($C_2$-$C_{10}$)alkyl (meth)acrylates, ($C_3$-$C_{12}$)perfluoroalkylethylthiocarbonylaminoethyl (meth)acrylates, (meth)acryloxyalkylsiloxanes, N-vinylcarbazole, ($C_1$-$C_{12}$) alkyl maleic, fumaric, itaconic, and mesaconic acid esters, vinyl acetate, vinyl propionate, vinyl butyrate, vinyl valerate, chloroprene, vinyl chloride, vinylidene chloride, vinyltoluene, vinyl ethyl ether, perfluorohexyl ethylthiocarbonylaminoethyl methacrylate, isobornyl methacrylate, trifluoroethyl methacrylate, hexa-fluoroisopropyl methacrylate, hexafluorobutyl methacrylate, tristrimethylsilyloxysilylpropyl methacrylate, and 3-methacryloxypropylpentamethyldisiloxane.

As used herein, the term "(meth)acrylate" means acrylate, methacrylate, or acrylate and methacrylate and the term (meth)acrylamide"means acrylamide, methacrylamide or acrylamide and methacrylamide.

In one embodiment, the polymer comprising monomeric units according to structure (I-a) a random copolymer. In another embodiment, the copolymer comprising monomeric units according to structure (I-a) is a block copolymer.

Methods for making suitable vinyl alcohol polymers are known in the art. In one embodiment, a polymer comprising monomeric units according to structure (I-a) is made by polymerizing one or more ethylenically unsaturated monomers, comprising at least one vinyl ester monomer, such vinyl acetate, by known free radical polymerization processes and subsequently hydrolyzing at least a portion of the vinyl ester monomeric units of the polymer to make a polymer having the desired degree of hydrolysis. In another embodiment, the polymer comprising monomeric units according to structure (I-a) is a copolymer made by known controlled free radical polymerization techniques, such as reversible addition fragmentation transfer (RAFT), macromolecular design via interchange of xanthates (MADIX), or atom transfer reversible polymerization (ATRP).

In one embodiment, the vinyl alcohol polymer is made by known solution polymerization techniques, typically in an aliphatic alcohol reaction medium.

In another embodiment, the vinyl alcohol polymer is made by known emulsion polymerization techniques, in the presence of one or more surfactants, in an aqueous reaction medium.

In one embodiment, the vinyl alcohol material comprises a microgel made by crosslinking molecules of a vinyl alcohol polymer.

In one embodiment the vinyl alcohol material comprises a salt, such as a sodium or potassium salt, of a vinyl alcohol polymer.

In one embodiment, the hydrophilizing layer comprises one or more poly(vinyl alcohol) polymers. Poly(vinyl alcohol) polymers are manufactured commercially by the hydrolysis of poly(vinyl acetate). In one embodiment, the poly(vinyl alcohol) has a molecular weight of greater than or equal to about 10,000 (which corresponds approximately to a degree of polymerization of greater than or equal to about 200), more typically from about 20,000 to about 200,000 (which corresponds approximately to a degree of polymerization of from about 400 to about 4000, wherein the term "degree of polymerization" means the number of vinyl alcohol units in the poly(vinyl alcohol) polymer. In one embodiment, the poly(vinyl alcohol) has a degree of hydrolysis of greater than or equal about 50, more typically greater than or equal about 88%.

In one embodiment, the hydrophilizing layer comprises an organophosphorus material (b)(I) and optional vinyl alcohol material (b)(II). For example, some potential weight ratios of these ingredients are as follows based on 100 pbw of the hydrophilizing layer:

from greater than 0 pbw to less than 100 pbw, or from about 0.1 pbw to about 99.9 pbw, or from about 1 pbw to about 99 pbw, organophosphorus material (b)(I), and optionally from greater than 0 pbw to less than 100 pbw, or from about 0.1 pbw to about 99.9 pbw, or from about 1 pbw to about 99 pbw, vinyl alcohol material (b)(II).

Liquid Carrier

In one embodiment, the treatment composition of the present invention comprises an organophosphorus material (b)(I) and optional vinyl alcohol material (b)(II) and a liquid carrier. For example, in one embodiment, the treatment composition of the present invention comprises the organophosphorus material (b)(I) and a liquid carrier.

In one embodiment, the liquid carrier is an aqueous carrier comprising water and the treatment solution is in the form of a solution, emulsion, or dispersion of the organophosphorus material and additives. In one embodiment, the liquid carrier comprises water and a water miscible organic liquid. Suitable water miscible organic liquids include saturated or unsaturated monohydric alcohols and polyhydric alcohols, such as, for example, methanol, ethanol, isopropanol, cetyl alcohol, benzyl alcohol, oleyl alcohol, 2-butoxyethanol, and ethylene glycol, as well as alkylether diols, such as, for example, ethylene glycol monoethyl ether, propylene glycol monoethyl ether and diethylene glycol monomethyl ether.

In one embodiment, the treatment composition comprises, based on 100 parts by weight ("pbw") of the composition:

from about 0.1 to about 20 pbw, or from about 1 to about 5 pbw, organophosphorus material, and from about 80 to 99 pbw, more typically, from about 90 to about 98 pbw, liquid carrier.

In one embodiment, the treatment composition further comprises, based on 100 parts by weight ("pbw") of the composition, from about 0.01 to about 10 pbw, or from about 0.1 to about 5 pbw, colloidal inorganic particles.

In one embodiment, the treatment composition further comprises, based on 100 parts by weight ("pbw") of the composition, from about 0.01 to about 2 pbw or from about 0.1 to about 0.5 pbw poly(vinyl alcohol).

In one embodiment, the treatment composition further comprises based on 100 parts by weight ("pbw") of the composition, from about 0.0001 to about 1 pbw or from about 0.001 to about 0.1 pbw multivalent cationic particles.

In one embodiment, the treatment composition of the present invention comprises an organophosphorus material (b)(I) and a vinyl alcohol material (b)(II) and a liquid carrier.

In one embodiment, the treatment composition comprises, based on 100 parts by weight ("pbw") of the composition, from about 0.1 to about 20 pbw, or from about 1 to about 5 pbw, organophosphorus material (b)(I), from about 0.1 to about 20 pbw, or from about 1 to about 5 pbw, vinyl alcohol material (b)(II), and from about 80 to 99 pbw, or from about 90 to about 98 pbw, liquid carrier.

The treatment composition may optionally further comprise, based on 100 pbw weight of the composition up to about 10 pbw of other components, such as, salts, sugars, surfactants, and rheology modifiers. Suitable salts include, for example, NaCl, KCl, $NH_3Cl$, $N(C_2H_5)_3Cl$. Suitable sugars include monosaccharides and polysaccharides, such as, for example, glucose or guar gum. Suitable rheology modifiers include, for example, alkali swellable polymers, such as acrylic acid polymers, hydrogen bridging rheology modifiers, such as carboxymethylcellulose or hydroxyethylcellulose, and hydrophobic associative thickeners, such as hydrophobically modified cellulose derivatives and hydrophobically modified alkoxylated urethane polymers.

In one embodiment, the hydrophilizing layer is deposited on at least a portion of the hydrophobic surface of a substrate by contacting the surface with a treatment solution comprising the organophosphorus material and a liquid carrier and then removing the liquid carrier. In one embodiment, the liquid carrier is a volatile liquid carrier and the carrier is removed by allowing the carrier to evaporate.

The hydrophobic surface of substrate may be contacted with the treatment composition by any convenient method such as, for example, by immersing the substrate in the treatment composition or by applying the treatment composition to the surface of the substrate by brushing or spraying.

In one embodiment, a hydrophilizing layer is deposited on the hydrophobic surface of the hard surface by treating the hard surface with the treatment composition.

In one embodiment, the hydrophilizing layer is deposited on at least a portion of the substrate by immersing the substrate in an aqueous treatment composition comprising the organophosphorus material and an aqueous carrier and then removing the aqueous carrier by evaporation to leave an amount of hydrophilizing layer disposed on at least a portion of the hard surface of the substrate.

In one embodiment, the hydrophilizing layer disposed on at least a portion of the hydrophobic surface of the substrate in an amount, typically from about 0.0001 gram to about 10 grams hydrophilizing layer per square meter of surface area, effective to decrease the hydrophobicity of the portion of the surface.

In one embodiment, the hydrophilized surface of the present invention comprises from about 0.017 to about 17, or from about 0.17, to about 3 grams of the hydrophilizing layer per square meter of surface area.

In one embodiment, the hydrophilized substrate of the present invention is a material having hydrophobic surfaces, such as, for example, hydrophobic synthetic polymeric surfaces, such as poly(olefin), and a hydrophilizing layer disposed on at least a portion of the surfaces in an amount effective to render the substrate sufficiently hydrophilic to facilitate cleaning with aqueous media. As used herein, terms "aqueous medium" and "aqueous media" are used herein to refer to any liquid medium of which water is a major component. Thus, the term includes water per se as well as aqueous solutions and dispersions.

In one embodiment, the hydrophilized substrate is durable, in the sense that at least a portion of the organophosphorus compound remains on the surfaces of the substrate when the hydrophilized substrate is contacted with an aqueous medium. One aspect of the durability of the hydrophilic properties of hydrophilized substrate of the present invention can be evaluated by rinsing a hydrophilized substrate in water and measuring the surface tension of rinse water. Although not a hard surface, this effect is demonstrated by testing a hydrophilized fiber substrate in which the rinse water exhibits a surface tension of from about 20 to about 70 milliNewtons per meter (mN/m), more preferably from about 25 to about 70 mN/m, as determined according to American Society for Testing and Materials test no. ASTM 1331 using a Wilhemy plate (Kruss Instruments). For example, the fabric is rinsed according to the following procedure:

(a) place a 20×18 cm sample of hydrophilized fabric in 40 milliliters of a 0.909 wt % NaCl aqueous solution,
(b) then stir the fabric in the solution for 10 seconds,
(c) then allow the fabric to sit without any agitation for 5 minutes,
(d) then stir the fabric in the solution for 10 seconds,
(e) then remove the fabric from the solution, and
(f) then allow the solution to rest for 10 minutes prior to making the surface tension measurement.

One aspect of the increased hydrophilicity of the hydrophilized substrate of the present invention can be evaluated by a "strikethrough" test on fibers. Although not a hard surface, the hydrophilized fabric, exhibits a strikethrough time, as determined according to European Disposable and Nonwovens Association test no. EDANA 150.3-96 of from less than about 10 seconds, more preferably from about 2 to about 5 seconds, and still more preferably from about 2 to about 4 seconds. The strikethrough time may be measured according to the following procedure:

(a) place a 12×12 cm sample of the hydrophilized fiber on top of a stack of 10 filter papers (ERT-FF3) and under a 50 mL separating funnel,
(b) then place a conductivity electrode on top of the stack of filter papers and under the treated fabric,
(c) deliver a 5 mL aliquot of an aqueous 0.909 wt % NaCl solution from a burette to the funnel (a "gush") and measuring the time (the "strikethrough time") from the moment the liquid touches the fabric until all liquid disappears into the stack of filter papers,
(d) optionally, repeating step (C) multiple times using the same fabric sample and stack of filter papers and recording the strikethrough time for each gush.

Surface-Active Agents

The cleaning or rinsing composition according to the invention additionally comprises at least one surface-active agent. The latter can be nonionic, anionic, amphoteric, zwitterionic or cationic.

Anionic Surface-Active Agents

Typical anionic surface-active agents for use in the present invention, by way of example, are:

alkyl ester sulfonates of formula R—CH($SO_3$M)-COOR', where R represents a $C_8$-$C_{20}$, preferably $C_{10}$-$C_{16}$, alkyl radical, R' represents a $C_1$-$C_6$, preferably $C_1$-$C_3$, alkyl radical and M represents an alkali metal (sodium, potassium or lithium) cation, a substituted or unsubstituted ammonium (methyl-, dimethyl-, trimethyl- or tetramethylammonium, dimethylpiperidinium, and the like) cation or a cation derived from an alkanolamine (monoethanolamine, diethanolamine, triethanolamine, and the like). Mention may very particularly be made of methyl ester sulfonates in which the R radical is $C_{14}$-$C_{16}$ radical;

alkyl sulfates of formula R$OSO_3$M, where R represents a $C_5$-$C_{24}$, preferably $C_{10}$-$C_{18}$, alkyl or hydroxyalkyl radical (such as salts of fatty acids derived from copra and tallow), M representing a hydrogen atom or a cation with the same definition as above, and their ethoxylenated (EO) and/or propoxylenated (PO) derivatives, having on average from 0.5 to 30, preferably from 0.5 to 10, EO and/or PO units;

alkylamide sulfates of formula RCONHR'$OSO_3$M, where R represents a $C_2$-$C_{22}$, preferably $C_6$-$C_{20}$, alkyl radical and R' represents a $C_2$-$C_3$ alkyl radical, M representing a hydrogen atom or a cation with the same definition as above, and their ethoxylenated (EO) and/or propoxylenated (PO) derivatives, having on average from 0.5 to 60 EO and/or PO units;

salts of saturated or unsaturated $C_8$-$C_{24}$, preferably $C_{14}$-$C_{20}$, fatty acids, $C_9$-$C_{20}$ alkylbenzenesulfonates, primary or secondary $C_8$-$C_{22}$ alkylsulfonates, alkylglycerolsulfonates, the sulfonated poly-carboxylic acids disclosed in GB-A-1 082 179, paraffin sulfonates, N-acyl-N-alkyltaurates, isethionates, alkylsuccinamates, alkylsulfo-succinates, monoesters or diesters of sulfosuccinates, N-acylsarcosinates, alkylglycoside sulfates, polyethoxycarboxylates, monoglyceride sulfates and condensates of fatty acid chlorides with hydroxyalkylsulfonates; the cation can be an alkali metal (sodium, potassium or lithium), a substituted or unsubstituted ammonium (methyl-, dimethyl-, trimethyl- or tetramethylammonium, dimethylpiperidinium, and the like) residue, or a residue derived from an alkanolamine (monoethanolamine, diethanolamine, triethanolamine, and the like);

alkyl phosphates, or alkyl or alkylaryl phosphate esters, such as Rhodafac RA600, Rhodafac PA15 or Rhodafac PA23, sold by Rhodia; the cation can be an alkali metal (sodium, potassium or lithium), a substituted or unsubstituted ammonium (methyl-, dimethyl-, trimethyl- or tetramethylammonium, dimethylpiperidinium, and the like) residue, or a residue derived from an alkanolamine (monoethanolamine, diethanolamine, triethanolamine, and the like).

Nonionic Surface-Active Agents

A description of nonionic surface-active agents is given in U.S. Pat. No. 4,287,080 and U.S. Pat. No. 4,470,923. Mention may in particular be made of condensates of alkylene oxide, in particular of ethylene oxide and optionally of propylene oxide, with alcohols, polyols, alkylphenols, fatty acid esters, fatty acid amides and fatty amines; amine oxides; sugar derivatives, such as alkylpolyglycosides or esters of fatty acids and of sugars, in particular sucrose monopalmitate; long-chain (of 8 to 28 carbon atoms) tertiary phosphine oxides; dialkyl sulfoxides; block copolymers of polyoxyethylene and of polyoxypropylene; polyalkoxylated esters of sorbitan; fatty esters of sorbitan; poly(ethylene oxide)s and fatty acid amides modified so as to confer thereon a hydrophobic nature (for example, fatty acid mono- and diethanolamides comprising from 10 to 18 carbon atoms).

Typical nonionic surface-active agents for use in the present invention, by way of example, are:

- polyoxyalkylenated $C_8$-$C_{18}$ aliphatic carboxylic acids comprising from 2 to 50 oxyalkylene (oxyethylene and/or oxypropylene) units, in particular of those with 12 (mean) carbon atoms or with 18 (mean) carbon atoms,
- polyoxyalkylenated $C_6$-$C_{24}$ aliphatic alcohols comprising from 2 to 50 oxyalkylene (oxyethylene and/or oxypropylene) units, in particular of those with 12 (mean) carbon atoms or with 18 (mean) carbon atoms; mention may be made of Antarox B12DF, Antarox FM33, Antarox FM63 and Antarox V74 from Rhodia, Plurafac LF 400 and Plurafac LF 220 from BASF, Rhodasurf ID 060, Rhodasurf ID 070 and Rhodasurf LA 42 from Rhodia and Synperonic A5, A7 and A9 from ICI,
- amine oxides, such as dodecyldi(2-hydroxyethyl)amine oxide,
- phosphine oxides, such as tetradecyldimethylphosphine oxide.

Amphoteric Surface-Active Agents

Typical amphoteric surface-active agents for use in the present invention, by way of example, are:

- sodium iminodipropionates or alkyliminopropionates, such as MIRATAINE H2C HA and MIRATAINE JC HA from Rhodia,
- alkyl amphoacetates or alkyl amphodiacetates, the alkyl group of which comprises from 6 to 20 carbon atoms, such as MIRANOL C2M Conc NP, sold by Rhodia,
- amphoteric alkylpolyamine derivatives, such as Amphionic XL®, sold by Rhodia, and Ampholac 7T/X® and Ampholac 7C/X®, sold by Berol Nobel.

Zwitterionic Surface-Active Agents

Typical zwitterionic surface-active agents for use in the present invention, by way of example, are disclosed in U.S. Pat. No. 5,108,660.

A number of suitable zwitterionic surfactants are alkyl dimethyl betaines, alkyl amidopropyldimethyl betaines, alkyl dimethyl sulfobetaines or alkyl amidopropyldimethyl sulfobetaines, such as MIRATAINE JCHA, MIRATAINE H2CHA or MIRATAINE CBS, sold by Rhodia, or those of the same type sold by Sherex Company under the name of "Varion CADG Betaine" and "Varion CAS Sulfobetaine", or the condensation products of fatty acids and of protein hydrolysates.

Other zwitterionic surfactants are also disclosed in U.S. Pat. No. 4,287,080 and in U.S. Pat. No. 4,557,853.

Another zwitterionic is a betaine, for example, those disclosed by US Patent Application Publication No. 2006/0217286 incorporated herein by reference in its entirety.

Cationic Surface-Active Agents

Typical cationic surface-active agents for use in the present invention include those of the quaternary ammonium salts of formula:

$$R^1R^2R^3R^4N^+X^-$$

where

- $R^1$, $R^2$ and $R^3$, which are identical or different, represent H or an alkyl group comprising less than 4 carbon atoms, preferably 1 or 2 carbon atom(s), which is optionally substituted by one or more hydroxyl functional group(s), or can form, together with the nitrogen atom N+, at least one aromatic or heterocyclic ring,
- $R^4$ represents a $C_8$-$C_{22}$, preferably $C_{12}$-$C_{22}$, alkyl or alkenyl group or an aryl or benzyl group, and
- $X^-$ is a solubilizing anion, such as halide (for example, chloride, bromide or iodide), sulfate or alkyl sulfate (methyl sulfate), carboxylate (acetate, propionate or benzoate), alkylsulfonate or arylsulfonate.

Mention may in particular be made of dodecyltrimethylammonium bromide, tetradecyltrimethylammonium bromide, cetyltrimethylammonium bromide, stearylpyridinium chloride, Rhodaquat® TFR and Rhodamine® C15, which are sold by Rhodia, cetyltrimethylammonium chloride (Dehyquart ACA and/or AOR from Cognis) or cocobis(2-hydroxyethyl)ethylammonium chloride (Ethoquad C12 from Akzo Nobel).

Mention may also be made of other cationic surface-active agents, such as:

quaternary ammonium salts of formula $$R^{1'}R^{2'}R^{3'}R^{4'}N^+X^-$$

where

- $R^{1'}$ and $R^{2'}$, which are identical or different, represent H or an alkyl group comprising less than 4 carbon atoms, preferably 1 or 2 carbon atom(s), which is optionally substituted by one or more hydroxyl functional group(s), or can form, together with the nitrogen atom $N^+$, a heterocyclic ring,
- $R^{3'}$ and $R^{4'}$ represent a $C_8$-$C_{22}$, preferably $C_{10}$-$C_{22}$, alkyl or alkenyl group or an aryl or benzyl group, and
- $X^-$ is an anion, such as halide (for example, chloride, bromide or iodide), sulfate or alkyl sulfate (methyl sulfate), carboxylate (acetate, propionate or benzoate), alkylsulfonate or arylsulfonate.

Mention may in particular be made of:

- dialkydimethylammonium chlorides, such as ditallowdimethylammonium chloride or methyl sulfate, and the like, or alkylbenzyldimethylammonium chlorides;
- ($C_{10}$-$C_{25}$)alkylimidazolium salts, such as ($C_{10}$-$C_{25}$)alkylimidazolinium methyl sulfates,
- salts of substituted polyamines, such as N-tallow-N,N',N'-triethanol-1,3-propylenediamine dichloride or di(methyl sulfate) or N-tallow-N,N,N',N',N'-pentamethyl-1,3-propylenediamine dichloride.

Additional examples of appropriate surfactants are compounds generally used as surface-active agents denoted in the well-known handbook "Surface Active Agents", volume 1, by Schwartz and Perry, and "Surface Active Agents and Detergents", volume 11, by Schwartz, Perry and Berch.

The surface-active agents represent from 0.005 to 60%, in particular from 0.5 to 40%, of the weight of the composition of the invention, this being according to the nature of the surface-active agent(s) and the destination of the cleaning composition.

Advantageously, an organophosphate ester (II)(1)/surface-active agent(s) ratio by weight is between 1/1 and 1/1000, advantageously 1/2 and 1/200.

Additional Additives

The cleaning or rinsing composition according to the invention can additionally comprise at least one other additive chosen in particular from conventional additives present in compositions for cleaning or rinsing hard surfaces.

Mention may be made of a number of potential additional additives.

Chelating agents, in particular of the water-soluble aminophosphonates and organic phosphonates type, such as:

- 1-hydroxyethane-1,1-diphosphonates,
- aminotri(methylenediphosphonate),
- vinyldiphosphonates,
- salts of oligomers or polymers of vinylphosphonic or vinyldiphosphonic acid,
- salts of random cooligomers or copolymers of vinylphosphonic or vinyldiphosphonic acid and of acrylic acid and/or of maleic anhydride and/or of vinylsulfonic acid and/or of acrylamidomethylpropanesulfonic acid,
- salts of phosphonated polycarboxylic acids,
- polyacrylates comprising phosphonate ending(s),
- salts of cotelomers of vinylphosphonic or vinyldiphosphonic acid and of acrylic acid, such as those of the Briquest® range or MIRAPOL A300 or 400 from Rhodia (in a proportion of 0 to 10%, preferably of 0 to 5%, of the total weight of cleaning composition).

Sequestering or scale-inhibiting agents, such as the following:

- polycarboxylic acids or their water-soluble salts and water-soluble salts of carboxylic polymers or copolymers, such as
  - polycarboxylates or hydroxypolycarboxylate ethers,
  - polyacetic acids or their salts (nitriloacetic acid, N,N-dicarboxymethyl-2-aminopentanedioic acid, ethylenediaminetetraacetic acid, diethylenetriaminepentaacetic acid, ethylene-diaminetetraacetates, nitriloacetates or N-(2-hydroxyethyl)nitrilodiacetates),
  - salts of ($C_5$-$C_{20}$ alkyl)succinic acids,
  - polycarboxylic acetal esters,
  - salts of polyaspartic or polyglutamic acids,
  - citric acid, adipic acid, gluconic acid or tartaric acid, or their salts,
- copolymers of acrylic acid and of maleic anhydride or acrylic acid homopolymers, such as Rhodoline DP 226 35 from Rhodia and SOKALAN CP5 from BASF (in a proportion of 0 to 10% of the total weight of said cleaning composition),
- sulfonated polyvinylstyrenes or their copolymers with acrylic acid, methacrylic acid, and the like, (in a proportion of 0 to 10% of the total weight of cleaning composition).

Inorganic builders (detergency adjuvants which improve the surface properties of surfactants) of the type:

- alkali metal, ammonium or alkanolamine polyphosphates, such as Rhodiaphos HD7, sold by Rhodia (in a proportion of 0 to 70% of the total weight of cleaning composition),
- alkali metal pyrophosphates,
- alkali metal silicates with an $SiO_2/M_2O$ ratio which can range from 1 to 4, preferably from 1.5 to 3.5, very particularly from 1.7 to 2.8; they can be amorphous silicates or lamellar silicates, such as the α, β, γ and δ phases of $Na_2Si_2O_5$, sold under the references NaSKS-5, NaSKS-7, NaSKS-11 and NaSKS-6 by Clariant,
- alkali metal or alkaline earth metal borates, carbonates, bicarbonates or sesquicarbonates (in an amount which can range up to approximately 50% of the total weight of said cleaning composition),
- cogranules of alkali metal silicate hydrates, with an $SiO_2/M_2O$ ratio which can range from 1.5 to 3.5, and of alkali metal (sodium or potassium) carbonates; mention may in particular be made of the cogranules in which the content by weight of water associated with the silicate with respect to the dry silicate is at least 33/100, it being possible for the ratio by weight of the silicate to the carbonate to range from 5/95 to 45/55, preferably from 15/85 to 35/65, such as disclosed in EP-A-488 868 and EP-A-561 656, for example Nabion 15, sold by Rhodia, (it being possible for the total amount of builders to represent up to 90% of the total weight of said cleaning or rinsing composition).

Bleaching agents of the perborates or percarbonates type, which may or may not be combined with acetylated bleaching activators, such as N,N,N',N'-tetraacetylethylenediamine (TAED), or chlorinated products of the chloroisocyanurates type, or chlorinated products of the alkali metal hypochlorites type, or aqueous hydrogen peroxide solution (in a proportion of 0 to 30% of the total weight of said cleaning composition).

Fillers of the sodium sulfate, sodium chloride, sodium carbonate, calcium carbonate, kaolin or silica type, in a proportion of 0 to 50% of the total weight of said composition.

Bleaching catalysts comprising a transition metal, in particular iron, manganese and cobalt complexes, such as those of the type $[Mn^{IV}_2(\mu\text{-}O)_3(Me_3TACN)_2](PF_6)_2$, $[Fe^{II}(MeN_4py)(MeCN)](ClO_4)_2$, $[(Co^{III})(NH_3)_5(OAc)](OAc)_2$, disclosed in U.S. Pat. Nos. 4,728,455, 5,114,606, 5,280,117, EP-A-909 809, U.S. Pat. No. 5,559,261, WO 96/23859, 96/23860 and 96/23861 (in a proportion of 0 to 5% of the total weight of said cleaning composition)

Agents which influence the pH of the composition, which are soluble in the cleaning or rinsing medium, in particular

- basifying additives (alkali metal phosphates, carbonates, perborates or alkali metal hydroxides) or
- optionally cleaning acidifying additives, such as inorganic acids (phosphoric, polyphosphoric, sulfamic, hydrochloric, hydrofluoric, sulfuric, nitric or chromic acid), carboxylic or polycarboxylic acids (acetic, hydroxyacetic, adipic, citric, formic, fumaric, gluconic, glutaric, glycolic, malic, maleic, lactic, malonic, oxalic, succinic and tartaric acid), or salts of acids, such as sodium bisulfate or alkali metal bicarbonates and sesquicarbonates.

Polymers used to control the viscosity of the mixture and/or the stability of the foams formed during use, such as cellulose derivatives or guar derivatives (carboxymethylcellulose, hydroxyethylcellulose, hydroxypropylguar, carboxymethylguar, carboxymethylhydroxypropylguar, and the like), xanthan gum, succinoglycan (Rheozan® sold by Rhodia), locust bean gum or carrageenans (in a proportion of 0 to 2% of the total weight of said cleaning composition).

Hydrotropic agents, such as short-chain $C_2$-$C_8$ alcohols, in particular ethanol, diols and glycols, such as diethylene glycol or dipropylene glycol, sodium xylenesulfonate or sodium naphthalenesulfonate (in a proportion of 0 to 10 g per 100 g of said cleaning composition).

Hydrating or moisturizing agents for the skin, such as glycerol or urea, or agents for protecting the skin, such as proteins or protein hydrolysates, vegetable oils, such as soybean oil, or cationic polymers, such as cationic guar derivatives (Jaguar C13S®, Jaguar C162® or Hicare 1000®, sold by Rhodia) (in a proportion of 0 to 40% of the total weight of said cleaning composition).

Biocides or disinfectants, such as

- cationic biocides, for example
  - mono(quaternary ammonium) salts, such as cocoalkylbenzyldimethylammonium, ($C_{12}$-$C_{14}$ alkyl)-benzyldimethylammonium, cocoalkyldichlorobenzyl-dimethylammonium, tetradecylbenzyldimethylammonium, didecyldimethylammonium or dioctyldimethylammonium chlorides, myristyltrimethylammonium or cetyltrimethylammonium bromides, monoquaternary heterocyclic amine salts, such as laurylpyridinium, cetylpyridinium or ($C_{12}$-$C_{14}$ alkyl)benzylimidazolium chlorides, (fatty alkyl)triphenylphosphonium salts, such as myristyltriphenylphosphonium bromide, polymeric biocides, such as those derived from the reaction of epichlorohydrin and of dimethylamine or of diethylamine, of epichlorohydrin and of imidazole, of 1,3-dichloro-2-propanol and of dimethylamine, of 1,3-dichloro-2-propanol and of 1,3-bis(dimethylamino)-2-propanol, of ethylene dichloride and of 1,3-bis(dimethylamino)-2-propanol, of bis(2-chloroethyl) ether and of N,N'-bis(dimethylaminopropyl)urea or -thiourea, biguanidine polymer hydrochlorides, such as VANTOCIL IB, amphoteric biocides, such as N—[N'—($C_8$-$C_{18}$ alkyl)-3-aminopropyl]glycine, N—{N'—[N"—($C_8$-$C_{18}$ alkyl)-2-aminoethyl]-2-aminoethyl}glycine or N,N-bis[N'—($C_8$-$C_{18}$ alkyl)-2-aminoethyl]glycine derivatives, such as (dodecyl)(aminopropyl)glycine or (dodecyl)(diethylenediamine)glycine, amines, such as N-(3-aminopropyl)-N-dodecyl-1,3-propanediamine, halogenated biocides, such as iodophores and hypochlorite salts, such as sodium dichloroisocyanurate, phenolic biocides, such as phenol, resorcinol, cresols or salicylic acid, hydrophobic biocides, such as para-chloro-meta-xylenol or dichloro-meta-xylenol, 4-chloro-m-cresol, resorcinol monoacetate, mono- or polyalkyl or -aryl phenols, cresols or resorcinols, such as o-phenylphenol, p-tert-butylphenol, or 6-(n-amyl)-n-cresol, alkyl and/or aryl chloro- or bromophenols, such as o-benzyl-p-chlorophenol, halogenated diphenyl ethers, such as 2 ',4,4'-trichloro-2-hydroxydiphenyl ether (triclosan) or 2,2'-dihydroxy-5,5'-dibromodiphenyl ether, chlorphenesin (p-chlorophenyl glyceryl ether), in a proportion of 0 to 50% of the total weight of said cleaning composition.

Solvents having a good cleaning or decreasing activity, such as:

alkylbenzenes of octylbenzene type, olefins having a boiling point of at least 100° C., such as α-olefins, preferably 1 -decene or 1 -dodecene, glycol ethers of general formula $R1O(R2O)_mH$, where R1 is an alkyl group exhibiting from 3 to 8 carbons and each R2 is either an ethylene or propylene and m is a number which varies from 1 to 3; mention may be made of monopropylene glycol monopropyl ether, dipropylene glycol monobutyl ether, monopropylene glycol monobutyl ether, diethylene glycol monohexyl ether, monoethylene glycol monohexyl ether, monoethylene glycol monobutyl ether and their mixtures, diols exhibiting from 6 to 16 carbon atoms in their molecular structure; diols are particularly advantageous as, in addition to their degreasing properties, they can help in removing calcium salts (soaps); diols comprising from 8 to 12 carbon atoms are preferred, very particularly 2,2,4-trimethyl-1,3-pentanediol, other solvents, such as pine oil, orange terpenes, benzyl alcohol, n-hexanol, phthalic esters of alcohols having 1 to 4 carbon atoms, butoxy propanol, Butyl Carbitol and 1-(2-(n-butoxy)-1-methylethoxy)propan-2-ol, also known as butoxypropoxy propanol or dipropylene glycol monobutyl ether, diglycol hexyl (Hexyl Carbitol), butyl triglycol, diols, such as 2,2,4-trimethyl-1,3-pentanediol, and their mixtures, (in a proportion of 0 to 30% of the total weight of said cleaning composition).

Industrial cleaners, such as solutions of alkali metal salts of the phosphate, carbonate, silicate, and the like, type of sodium or potassium (in a proportion of 0 to 50% of the total weight of said cleaning composition).

Water-soluble organic solvents with little cleaning effect, such as methanol, ethanol, isopropanol, ethylene glycol, propylene glycol and their mixtures (in a proportion of 0 to 40% of the total weight of said cleaning composition).

Cosolvents, such as monoethanolamide and/or β-aminoalkanols, which are particularly advantageous in compositions with a pH of greater than 11, very particularly of greater than 11.7, as they help in reducing the formation of films and marks on hard surfaces (they can be employed in a proportion of 0.05 to 5% of the weight of the cleaning composition); solvent systems comprising monoethanolamide and/or β-aminoalkanols are disclosed in U.S. Pat. No. 5,108,660.

Antifoaming agents, such as soaps in particular. Soaps are alkali metal salts of fatty acids, in particular sodium, potassium, ammonium and alkanolammonium salts of higher fatty acids comprising approximately from 8 to 24 carbon atoms and preferably from approximately 10 to approximately 20 carbon atoms; mention may in particular be made of mono-, di- and triethanolamine, sodium and potassium salts of mixtures of fatty acids derived from coconut oil and from ground walnut oil. The amount of soap can be at least 0.005% by weight, preferably from 0.5 to 2% by weight, with respect to the total weight of the composition. Additional examples of foam modifiers are organic solvents, hydrophobic silica, silicone oil and hydrocarbons.

Abrasives, such as silica or calcium carbonate.

Various additives, such as enzymes, silicates, fragrances, colorants, agents which inhibit corrosion of metals, preservatives, optical brighteners, opacifying or pearlescent agents, and the like.

The pH of the composition forming the subject matter of the invention or the pH of use of said composition can range from 0.5 to 14, preferably from 1 to 14.

Compositions of Alkaline Type

Compositions of alkaline type, with a pH of greater than or equal to 7.5, preferably of greater than 8.5, for domestic applications (very particularly with a pH from 8.5 to 12, in particular from 8.5 to 11.5) are of particular use for the removal of greasy soiling substances and are particularly well suited to the cleaning of kitchens.

They can typically comprise from 0.001 to 5%, or 0.005 to 2%, of their weight of organophosphorus material (b)(I).

The alkaline compositions generally comprise, in addition to the organophosphorus (b)(I), at least one additive chosen from the following:

a sequestering or scale-inhibiting aqent (in an amount ranging from 0 to 40%, preferably from 1 to 40%, or from 2 to 30% or from 5 to 20%, of the weight of the composition), a cationic biocide or disinfectant, in particular of quaternary ammonium type, such as (N-alkyl)benzyldimethylammonium chlorides, (N-alkyl)dimethyl(ethylbenzyl)ammonium chloride, N-didecyldimethylammonium halide and di(N-alkyl)dimethylammonium chloride (in an amount which can range from 0 to 60%, preferably from 0 to 40%, more preferably from 0 to 15% and very particularly from 0 to 5%, of the weight of the composition), at least one nonionic, amphoteric, zwitterionic or anionic surface-active agent or their mixture; when a cationic surface-active agent is present, said composition in addition preferably comprises an amphoteric and/or nonionic surface-active agent (the total amount of surface-active agents can range from 0 to 80%, preferably from 0 to 50%, very particularly from 0 to 35%, of the weight of the composition), if necessary, a pH modifier, in an amount which makes it possible to achieve, optionally after diluting or dissolving the composition, a pH of use ranging from 7.5 to 13; the pH modifier can in particular be a buffer system comprising monoethanolamine and/or a β-aminoalkanol and potentially but preferably "cobuffer" alkaline materials from the group consisting of aqueous ammonia, $C_2$-$C_4$ alkanolamines, silicates, borates, carbonates, bicarbonates, alkali metal hydroxides and their mixtures. The preferred cobuffers are alkali metal hydroxides.

from 0.5 to 98%, preferably from 25 to 95%, very particularly from 45 to 90%, by weight of water, a cleaning or degreasing organic solvent, in an amount which can represent from 0 to 60%, preferably from 1 to 45%, very particularly from 2 to 15%, of the weight of said composition, a cosolvent, such as monoethanolamine and/or β-aminoalkanols, in an amount which may represent from 0 to 10%, preferably from 0.05 to 10%, very particularly from 0.05 to 5%, by weight of said composition, a water-soluble organic solvent with little cleaning effect, in an amount which can represent from 0 to 25%, preferably from 1 to 20%, very particularly from 2 to 15%, of the weight of said composition, optionally a bleaching agent, a fragrance or other conventional additives.

The alkaline compositions can be provided in the form of a ready-for-use formulation or else of a dry or concentrated formulation to be diluted in water in particular before use; they can be diluted from 1- to 10 000-fold, preferably from 1- to 1000-fold, before use.

Advantageously, a formulation for cleaning kitchens comprises:

from 0.001 to 1% by weight of organophosphorus compound (B)(1), from 1 to 10% by weight of water-soluble solvent, in particular isopropanol, from 1 to 5% by weight of cleaning or degreasing solvent, in particular butoxypropanol, from 0.1 to 2% by weight of monoethanolamine, from 0 to 5% by weight of at least one noncationic surface-active agent, preferably an amphoteric or nonionic surface-active agent, from 0 to 1 % by weight of at least one cationic surface-active agent with a disinfecting property (in particular mixture of (n-alkyl)dimethyl(ethylbenzyl)-ammonium chloride and (n-alkyl)dimethylbenzylammonium chloride), the total amount of surface-active agent(s) representing from 1 to 50% by weight, from 0 to 2% by weight of a dicarboxylic acid as scale-inhibiting agent, from 0 to 5% of a bleaching agent, and from 70 to 98% by weight of water.

The pH of such a formulation is typically from 7.5 to 13, or from 8 to 12.

Compositions of Acidic Type

Compositions of acidic type, with a pH of less than 5, are of particular use for the removal of soiling substances of inorganic type; they are particularly well suited to the cleaning of toilet bowls.

They typically comprise from 0.001 to 5%, or from 0.01 to 2%, of their weight of organophosphorus material (b)(I).

The acidic compositions generally comprise, in addition to the organophosphorus material (b)(I), the following:

an inorganic or organic acidic agent (in an amount ranging from 0.1 to 40%, preferably from 0.5 to 20% and more preferably from 0.5 to 15%, of the weight of the composition), at least one nonionic, amphoteric, zwitterionic or anionic surface-active agent or their mixture (the total amount of surface-active agents can range from 0.5 to 20%, preferably from 0.5 to 10%, of the weight of the composition), optionally a cationic biocide or disinfectant, in particular of quaternary ammonium type such as (N-alkyl)benzyldimethylammonium chloride, (N-alkyl)dimethyl (ethylbenzyl)ammonium chloride, N-didecyl-dimethylammonium halide and di(N-alkyl)dimethylammonium chloride (in an amount which can range from 0.01 to 2%, preferably from 0.1 to 1%, of the weight of the composition), optionally a thickening agent (in an amount ranging from 0.1 to 3% of the weight of the composition), optionally a bleaching agent (in an amount ranging from 1 to 10% of the weight of the composition), from 0.5 to 99%, preferably from 50 to 98%, by weight of water, a solvent, such as glycol or an alcohol (in an amount which can range from 0 to 10%, preferably from 1 to 5%, of the weight of the composition), optionally a fragrance, a preservative, an abrasive or other conventional additives.

The acidic compositions are preferably provided in the form of a ready-for-use formulation.

Advantageously, a formulation for cleaning toilet bowls comprises:

from 0.05 to 5%, preferably from 0.01 to 2%, by weight of organophosphorus material (b)(I), an amount of acidic cleaning agent such that the final pH of the composition is from 0.5 to 4, preferably from 1 to 4; this amount is generally from 0.1 to approximately 40% and preferably between 0.5 and approximately 15% by weight, with respect to the weight of the composition; the acidic agent can be in particular an inorganic acid, such as phosphoric, sulfamic, hydrochloric, hydrofluoric, sulfuric, nitric or chromic acid and mixtures of these, an organic acid, in particular acetic, hydroxyacetic, adipic, citric, formic, fumaric, gluconic, glutaric, glycolic, malic, maleic, lactic, malonic, oxalic, succinic or tartaric acid and mixtures of these, or acid salts, such as sodium bisulfate, and mixtures of these;

the preferred amount depends on the type of acidic cleaner used: for example, with sulfamic acid, it is between 0.2 and 10%, with hydrochloric acid between 1 and 15%, with citric acid between 2 and 15%, with formic acid between 5 and 15% and with phosphoric acid between 2 and 30%, by weight, from 0.5 to 10% by weight of at least one surface-active agent, preferably an anionic or nonionic surface-active agent, optionally from 0.1 to 2% by weight of at least one cationic surface-active agent with a disinfecting property (in particular mixture of (n-alkyl)dimethyl(ethylbenzyl)ammonium chloride and (n-alkyl)dimethylbenzylammonium chloride), optionally a thickening agent (in an amount ranging from 0.1 to 3% of the weight of the composition) of gum type, in particular a xanthan gum or a succinoglycan (RHEOZAN), optionally a bleaching agent (in an amount ranging from 1 to 10% of the weight of the composition), optionally a preservative, a colorant, a fragrance or an abrasive, and from 50 to 95% by weight of water.

A few other specific embodiments and forms of application of the composition of the invention are clarified below.

Thus, the composition according to the invention can be employed for making easier the cleaning treatment of glass surfaces, in particular of windows. This treatment can be carried out by the various known techniques. Mention may be made in particular of the techniques for cleaning windows by spraying with a jet of water using devices of the Kärcher® type.

The amount of organophosphorus (b)(I) introduced will generally be such that, during the use of the cleaning composition, after optional dilution, the concentration of organophosphorus (b)(I) is between 0.001 g/l and 2 g/l, preferably between 0.005 g/l and 0.5 g/l.

The composition for cleaning windows according to the invention typically comprises:

from 0.001 to 10%, or 0.005 to 3%, by weight of at least one organophosphorus material (b)(I);

from 0.005 to 20%, preferably from 0.5 to 10%, by weight of at least one nonionic surface-active agent (for example an amine oxide or an alkyl polyglucoside) and/or anionic surface-active agent; and the remainder being formed of water and/or of various additives which are conventional in the field.

The cleaning formulations for windows comprising said polymer can also comprise:

from 0 to 10%, advantageously from 0.5 to 5%, of amphoteric surfactant, from 0 to 30%, advantageously from 0.5 to 15%, of solvent, such as alcohols, the remainder being composed of water and of conventional additives (in particular fragrances).

The pH of the composition is advantageously between 1 and 6.

Detergent Compositions for Washing Dishes in Automatic Dishwashers

The composition of the invention is also advantageous for making easier the cleaning of dishes in an automatic device. The composition can be either a detergent (cleaning) formulation used in the washing cycle or a rinsing formulation.

The detergent compositions for washing dishes in automatic dishwashers according to the invention advantageously comprise from 0.01 to 5%, or 0.1 to 3%, by weight of organophosphorus material (b)(I).

The detergent compositions for dishwashers also comprise at least one surface-active agent, preferably a nonionic surface-active agent, in an amount which can range from 0.2 to 10%, preferably from 0.5 to 5%, of the weight of said detergent composition, the remainder being composed of various additives and of fillers, as already mentioned above.

Thus, they can additionally comprise up to 90% by weight of at least one detergency adjuvant (builder) of sodium tripolyphosphate or silicate type, up to 10%, preferably from 1 to 10%, very particularly from 2 to 8%, by weight of at least one auxiliary cleaning agent, preferably a copolymer of acrylic acid and of methylpropanesulfonic acid (AMPS), up to 30% by weight of at least one bleaching agent, preferably perborate or percarbonate, which may or may not be combined with a bleaching activator, up to 50% by weight of at least one filler, preferably sodium sulfate or sodium chloride.

up to 1% by weight of at least one enzyme, enzyme stabilizer and enzyme activator.

up to 10% by weight of at least one dispersant, preferably an acrylate homopolymer, acrylate copolymers or any mixtures thereof.

The pH is advantageously between 8 and 14.

Compositions for Improving Rinsing of Dishes in Automatic Dishwashers

The compositions for making easier the rinsing of dishes in automatic dishwashers according to the invention can advantageously comprise from 0.02 to 10%, or from 0.1 to 5%, by weight of organophosphorus material (b)(I), with respect to the total weight of the composition.

The compositions can also comprise from 0.1 to 20%, preferably 0.2 to 15%, by weight, with respect to the total weight of said composition, of a surface-active agent, preferably a nonionic surface-active agent.

Mention may be made, among preferred nonionic surface-active agents, of surface-active agents of the following types: polyoxyethylenated $C_6$-$C_{12}$ alkylphenols, polyoxyethylenated and/or polyoxypropylenated $C_8$-$C_{22}$ aliphatic alcohols, ethylene oxide/propylene oxide block copolymers, optionally polyoxyethylenated carboxamides, and the like.

The compositions can additionally comprise from 0 to 10%, preferably from 0.5 to 5%, by weight, with respect to the total weight of the composition, of a calcium-sequestering organic acid, preferably citric acid.

They can also comprise an auxiliary agent of acrylate homopolymers, acrylate copolymers and any mixtures thereof, in a proportion of 0 to 15%, preferably 0.5 to 10%, by weight, with respect to the total weight of said composition.

The pH is advantageously between 4 and 12.

Compositions for Hand Washing Dishes

Another subject matter of the invention is a cleaning composition for making easier the washing of dishes by hand.

Preferred detergent formulations of this type comprise from 0.1 to 10 parts by weight of organophosphorus material (b)(I) per 100 parts by weight of said composition and comprise from 3 to 50, preferably from 10 to 40, parts by weight of at least one surface-active agent, preferably an anionic surface-active agent, chosen in particular from sulfates of saturated $C_5$-$C_{24}$, preferably $C_8$-$C_{16}$, aliphatic alcohols, optionally condensed with approximately from 0.5 to 30, preferably 0.5 to 8, very particularly 0.5 to 5, mol of ethylene oxide, in the acid form or in the form of a salt, in particular an alkali metal (sodium) salt, alkaline earth metal (calcium, magnesium) salt, and the like.

Preferably, they are lathering liquid aqueous detergent formulations for making easier the washing of dishes by hand.

The formulations can additionally comprise other additives, in particular other surface-active agents, such as:

- nonionic surface-active agents, such as amine oxides, alkylglucamides, alkyl polyglucosides, oxyalkylenated derivatives of fatty alcohols, alkylamides or alkanolamides, or amphoteric or zwitterionic surface-active agents,
- noncationic bactericides or disinfectants, such as triclosan,
- synthetic cationic polymers,
- polymers for controlling the viscosity of the mixture and/or the stability of the foams formed during use,
- hydrotropic agents,
- hydrating or moisturizing agents or agents for protecting the skin,
- up to 10% by weight of at least one dispersant, preferably an acrylate homopolymer, acrylate copolymers or any mixtures thereof.
- colorants, fragrances, preservatives, divalent salts (in particular magnesium salts), rheology modifiers and the like.

The pH of the composition is advantageously between 4 and 10.

Exterior Cleaning

Another specific embodiment of the invention is a composition for making easier the exterior cleaning, in particular of the bodywork, of motorized vehicles (automobiles, trucks, buses, trains, planes, and the like) or buildings, e.g., facades, or outdoor stone work and sculptures.

In this case also, the hard surface cleaning composition can be a cleaning composition proper or a rinsing composition.

The cleaning composition for exterior cleaning advantageously comprises from 0.005 to 10% by weight of organophosphorus material (b)(I), with respect to the total weight of said composition, and:

- nonionic surface-active agents (in a proportion of 0 to 30%, preferably of 0.1 to 15%, of the formulation),
- amphoteric and/or zwitterionic surface-active agents (in a proportion of 0 to 30%, preferably of 0.01 to 10%, of the formulation),
- cationic surface-active agents (in a proportion of 0 to 30%, preferably of 0.5 to 15%, of the formulation),
- anionic surface-active agents (in a proportion of 0 to 30%, preferably of 0.1 to 15%, of the formulation),
- detergency adjuvants (builders) (in a proportion of 1 to 99%, preferably of 40 to 98%, of the formulation),
- hydrotropic agents,
- fillers, pH modifiers, rheology modifiers and the like.

The minimum amount of surface-active agent present in this type of composition is preferably at least 0.5% of the formulation.

The pH of the composition is advantageously between 8 and 13.

Ceramic Cleaner

The composition of the invention is also particularly suitable for making easier the cleaning of hard surfaces of ceramic type (tiling, bath tubs, bathroom sinks, and the like), in particular for bathrooms.

The cleaning formulation advantageously comprises from 0.02 to 5% by weight of organophosphorus material (b)(I), with respect to the total weight of said composition, and at least one surface-active agent.

Preference is given, as surface-active agents, to nonionic surface-active agents, in particular the compounds produced by condensation of alkylene oxide groups of hydrophilic nature with a hydrophobic organic compound which can be of aliphatic or alkylaromatic nature.

The length of the hydrophilic chain or of the polyoxyalkylene radical condensed with any hydrophobic group can be readily adjusted in order to obtain a water-soluble compound having the desired degree of hydrophilic/hydrophobic balance (HLB).

The amount of nonionic surface-active agents in the composition of the invention can be from 0 to 30% by weight, preferably from 0 to 20% by weight.

An anionic surfactant can optionally be present in an amount of 0 to 30%, advantageously 0 to 20%, by weight.

It is also possible, but not essential, to add amphoteric, cationic or zwitterionic detergents.

The total amount of surface-active compounds employed in this type of composition is generally between 0.5 and 50%, preferably between 1 and 30%, by weight and more particularly between 2 and 20% by weight, with respect to the total weight of the composition.

The cleaning composition can also comprise other minor ingredients, such as:

- detergency adjuvants (builders) as mentioned above (in an amount which can be between 0.1 and 25% by weight, with respect to the total weight of the composition),
- a foam modifier as mentioned above, in particular of soap type (in an amount generally of at least 0.005% by weight, preferably of 0.5% to 2% by weight, with respect to the total weight of the composition),
- pH modifiers, colorants, optical brighteners, agents for suspending soiling substances, detergent enzymes, enzyme activators, enzyme stabilizers, compatible bleaching agents, agents for controlling gel formation, freezing-thawing stabilizers, bactericides, preservatives, solvents, fungicides, insect repellants, hydrotropic agents, fragrances and opacifying or pearlescent agents.

The pH of the composition is advantageously between 2 and 12.

Shower Wall Rinsing Composition

The composition according to the invention is also suitable for making easier the rinsing of shower walls.

The aqueous compositions for rinsing shower walls comprise from 0.02% to 5% by weight, advantageously from 0.05 to 1 %, of organophosphorus material (b)(I).

The other main active components of the aqueous compositions for rinsing showers of the present invention are at least one surface-active agent, present in an amount ranging from 0.5 to 5% by weight, and optionally a metal-chelating chelating agent as mentioned above, present in an amount ranging from 0.01 to 5% by weight.

The aqueous compositions for rinsing showers advantageously comprise water with, optionally, a major proportion of at least one lower alcohol and a minor proportion of additives (between approximately 0.1 and approximately 5% by weight, more advantageously between approximately 0.5% and approximately 3% by weight and more preferably still between approximately 1% and approximately 2% by weight).

Some surface-active agents which can be used in this type of application are disclosed in patents U.S. Pat. Nos. 5,536,452 and 5,587,022, the content of which is incorporated by reference in the present description.

Preferred surfactants are polyethoxylated fatty esters, for example polyethoxylated sorbitan monooleates and polyethoxylated castor oil. Specific examples of such surface-active agents are the condensation products of 20 mol of ethylene oxide and of sorbitan monooleate (sold by Rhodia Inc. under the name Alkamuls PSMO-20® with an HLB of 15.0) and of 30 or 40 mol of ethylene oxide and of castor oil (sold by Rhodia Inc. under the names Alkamuls EL-620® (HLB of 12.0) and EL-719® (HLB of 13.6) respectively). The degree of ethoxylation is preferably sufficient to obtain a surfactant with an HLB of greater than 13.

The pH of the composition is advantageously between 7 and 14.

Glass-Ceramic Sheets Cleaning Composition

The composition according to the invention can also be employed for making easier the cleaning of glass-ceramic sheets.

Advantageously, the formulations for cleaning glass-ceramic sheets of the invention comprise:

0.01 to 5% by weight of organophosphorus material (b)(I), 0.1 to 1% by weight of a thickener, such as a xanthan gum, 10 to 60% by weight of an abrasive agent, such as calcium carbonate or silica;

0 to 7% by weight of a solvent, such as butyl diglycol, 1 to 10% by weight of a nonionic surface-active agent, and optionally basifying agents or sequestering agents.

The pH of the composition is advantageously between 7 and 14.

Reactor Cleaning Composition

As mentioned above, the composition according to the invention can also be employed in the field of industrial cleaning, in particular for making easier the cleaning of reactors.

Advantageously, the compositions comprise:

from 0.02 to 5% by weight of organophosphorus material (b)(I), from 1 to 50% by weight of alkali metal salts (sodium or potassium phosphates, carbonates, silicates), from 1 to 30% by weight of a mixture of surface-active agents, in particular of nonionic surface-active agents, such as ethoxylated fatty alcohols, and anionic surface-active agents, such as laurylbenzenesulfonate, from 0 to 30% by weight of a solvent, such as diisobutyl ether.

The pH of such a composition is generally from 1 to 14.

A second subject matter of the invention is the use, in a composition comprising at least one surface-active agent for cleaning or rinsing hard surfaces in an aqueous or aqueous/alcoholic medium, of at least one organophosphorus material (b)(I) as agent which makes it possible to contribute to the surfaces antideposition and/or antiadhesion properties with regard to soiling substances capable of being deposited on said surfaces.

A third subject matter of the invention is a method for improving the properties of compositions comprising at least one surface-active agent for cleaning or rinsing hard surfaces in a solvent medium (water, alcoholic, etc. . . . ) by addition to said compositions of at least organophosphorus material (b)(I).

A fourth subject matter of the invention is a method for facilitating the cleaning or rinsing of hard surfaces by bringing said surfaces into contact with a composition in a solvent medium (water, alcoholic, et.) comprising at least one surface-active agent and at least one organophosphorus material (b)(I) employed or is present in the composition in an amount effective in contributing to said surfaces antideposition and/or antiadhesion properties with regard to soiling substances capable of being deposited on said surfaces.

The nature and the amounts of the organophosphorus compound (b)(I) present or employed in the composition, as well as the other additives and various forms of application of the composition, have already been mentioned above.

EXAMPLES

Example 1

Egg Shell Tests

In this example egg-shell was stained with green/black tea stain.

FIG. 1 shows a photograph of egg-shell brushed with commercial toothpaste, then stained with green (left) and black (right) tea, and then brushed again with commercial toothpaste. This resulted in no removal of tea stain.

Figure 2:
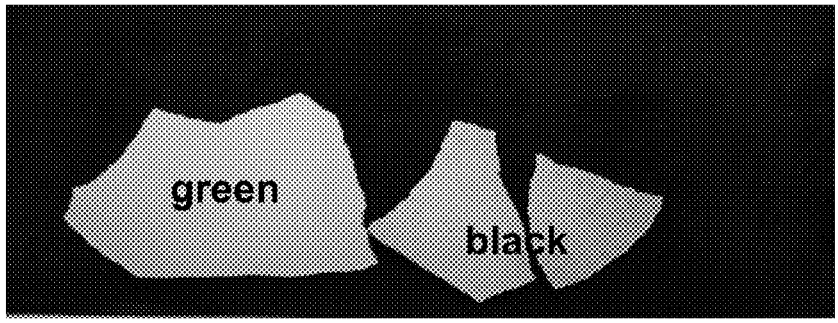
FIG. 2 shows a photograph of egg-shell brushed with commercial toothpaste plus 20% PEG400 phosphate ester (polyethylene glycol 400 phosphate ester), then stained with green (left) and black (right) tea, and then brushed again with toothpaste plus 20% PEG400 phosphate ester.

In another experiment PEG400 phosphate ester (a polyethylene glycol phosphate ester) was mixed directly into the toothpaste without neutralization. An egg-shell was brushed with commercial toothpaste plus 20% PEG400 phosphate ester, then stained with green and black tea, and then brushed again with commercial tooth-paste plus 20% PEG400 phosphate ester. FIG. 2 shows a photograph of the egg-shell brushed with the commercial toothpaste plus 20% PEG400 phosphate ester, then stained with green (left) and black (right) tea, and then brushed again with commercial toothpaste plus 20% PEG400 phosphate ester. This resulted in good removal of tea stain.

Figure 3:
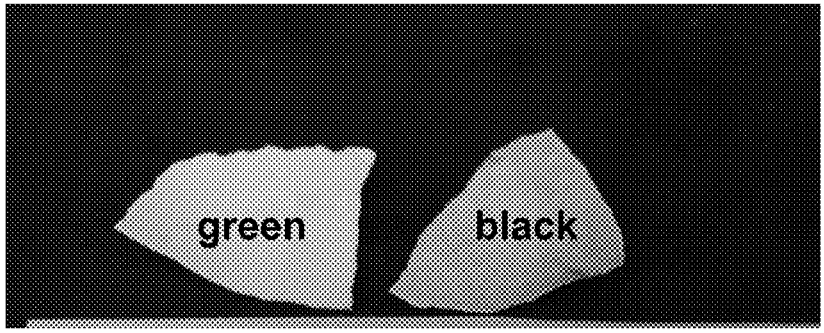
FIG. 3 shows a photograph of egg-shell brushed with commercial toothpaste plus 20% SDS, then stained with green (left) and black (right) tea, and then brushed with commercial toothpaste plus 20% SDS.

In another experiment 20% sodium dodecyl sulphate (SDS) was mixed into the commercial toothpaste. The 20% SDS was used as a 100% powder. FIG. 3 shows a photograph of egg-shell brushed with the commercial toothpaste plus 20% SDS, then stained with green (left) and black (right) tea, and then brushed with commercial toothpaste plus 20% SDS. This resulted in no/slight removal of tea stain.

Figure 4:
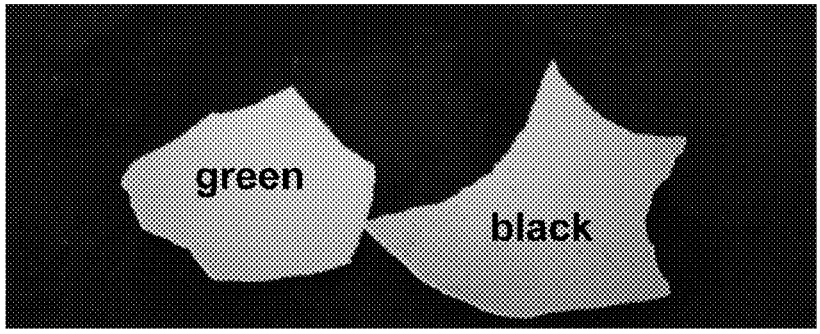
FIG. 4 shows a photograph of egg-shell brushed with commercial toothpaste plus 20% PEG1000 phosphate ester, then stained with green (left) and black (right) tea, and then brushed again with commercial toothpaste plus 20% P1000 phosphate ester.

In another experiment PEG1000 phosphate ester (a polyethylene glycol phosphate ester) was mixed directly into the toothpaste without neutralization. FIG. 4 shows a photograph of egg-shell brushed with commercial toothpaste plus 20% PEG1000 phosphate ester (a polyethylene glycol phosphate ester), then stained with green (left) and black (right) tea, and then brushed again with commercial toothpaste plus 20% PEG1000 phosphate ester. This resulted in good removal of tea stain.

In a separate test it was noted that treatment of egg-shell with SDS or PEG phosphate ester, then staining and then simple rinsing does not improve removal of stain compared to untreated egg-shell. This implies improved cleaning is not due to creation of anti-soiling layer, but due to better cleaning capability.

Example 2

Figure 5:
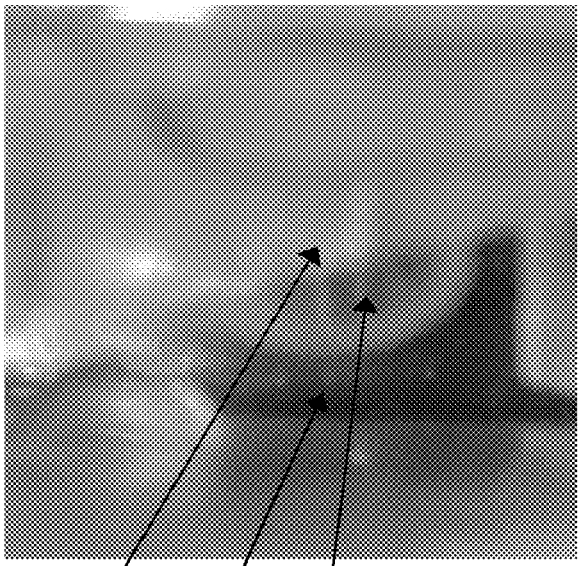
FIG. 5 shows a droplet of hexadecane under pure deionized water on $CaCO_3$ crystal.
Figure 7:
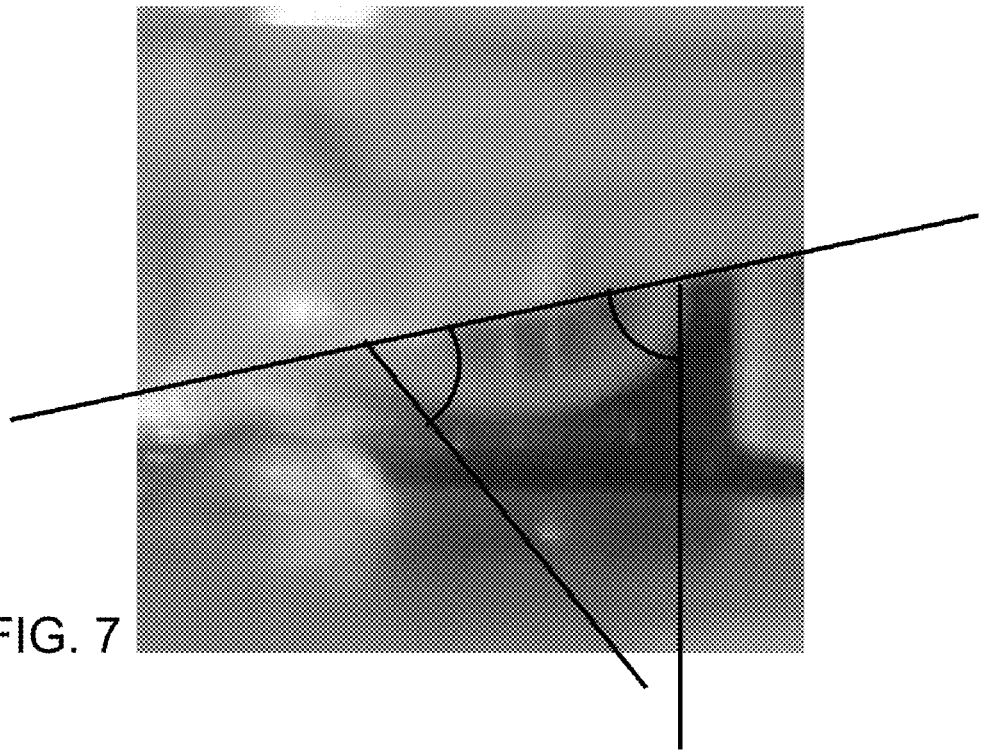
FIG. 7 is FIG. 5 labeled to show the contact angle.

FIG. 5 shows a droplet of hexadecane under pure deionized water on CaCO3 crystal. FIG. 7 is FIG. 5 labeled to show the contact angle. FIG. 7 shows the contact angle was 60°-80°.

Figure 6:
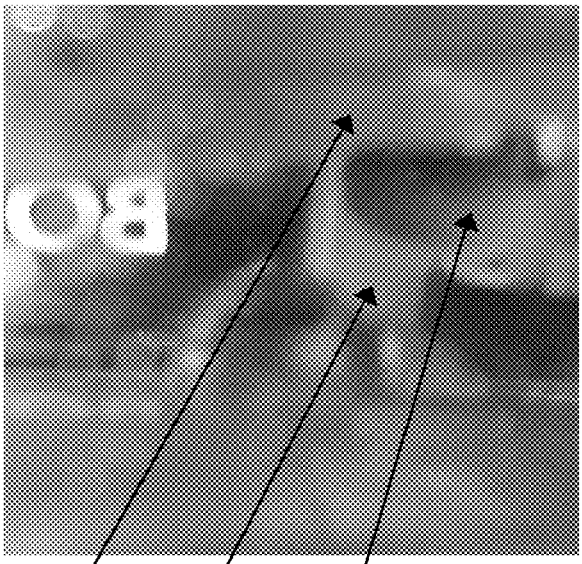
FIG. 6 shows a droplet of hexadecane under 1 wt. % PEG 1000 phosphate ester on $CaCO_3$ crystal pretreated with PEG1000 phosphate ester on $CaCO_3$ crystal to show the adsorption of PEG1000 phosphate ester onto the $CaCO_3$ crystal increases the contact angle of hexadecane on $CaCO_3$ under water.
Figure 8:
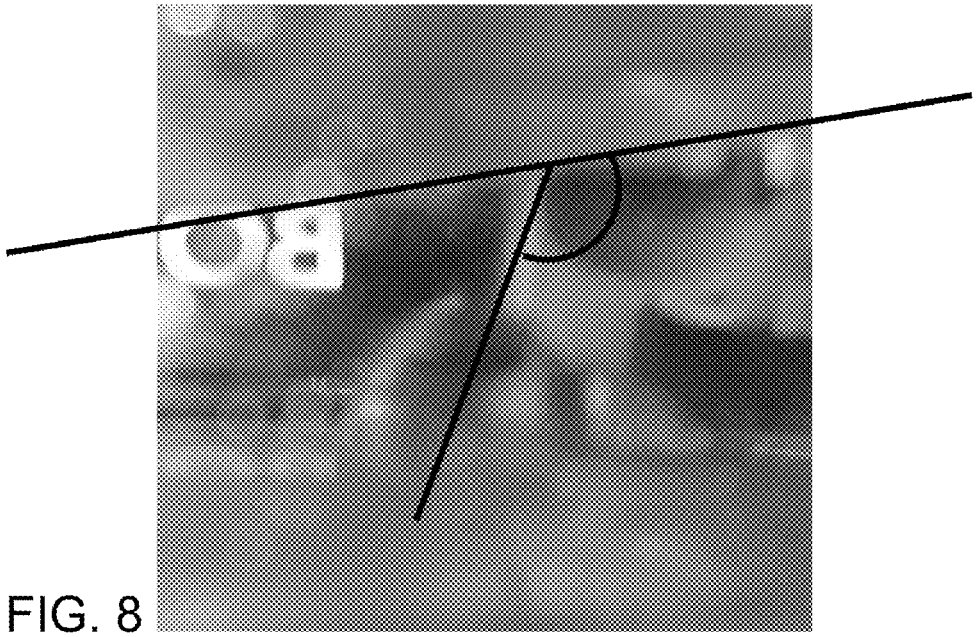
FIG. 8 is FIG. 6 labeled to show the contact angle.

FIG. 6 shows a droplet of hexadecane under a solution containing 1 wt % PEG1000 phosphate ester at a pH of 10 on a CaCO3 crystal. This shows the presence of PEG1000 phosphate ester, increases the contact angle of hexadecane on CaCO3. The pretreatment of calcium carbonate crystal was done by immersing the crystal in an aqueous solution of e.g. PEG1000 phosphate ester (e.g. 1 wt %, pH 9-10). A successful adsorption onto the crystal and a respective change of the surface properties is shown by measuring the contact angle of hexadecane. FIG. 8 is FIG. 6 labeled to show the contact angle. FIG. 8 shows the contact angle was >130°.

Comparison of FIGS. 7 and 8 shows the presence of PEG1000 phosphate ester onto the CaCO3 crystal increases the contact angle of hexadecane on CaCO3 from <80° to >130°.

Thus, a low contact angle is observed for the crystal in pure water (i.e. good adsorption of the oil onto the crystal, which is undesirable) and a high contact angle is observed for the crystal in a solution of water and PEG 1000 phosphate ester (i.e. poor adsorption of the oil onto the crystal, which is desirable).

It is apparent that embodiments other than those expressly described above come within the spirit and scope of the present claims. Thus, the present invention is not defined by the above description, but rather is defined by the claims appended hereto.

The invention claimed is:

1. A hydrophilized article, comprising:

(a) a substrate having a hydrophobic hard surface, and (b) a hydrophilizing layer disposed on at least a portion of the hydrophobic surface of the substrate, said layer comprising:

(b)(I) an organophosphorus material selected from the group consisting of:

(b)(I)(1) organophosphorus compounds according to structure (I):

(I)

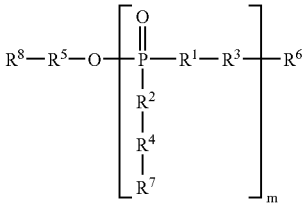

wherein:

each $R^1$ and $R^2$ are independently absent or O, provided that at least one of $R^1$ and $R^2$ is O, each $R^3$ is independently alkyleneoxy, poly(alkyleneoxy) group, which may optionally be substituted on one or more carbon atoms of such alkyleneoxy, or poly(alkyleneoxy) group by hydroxyl, alkyl, hydroxyalkyl, alkoxy, alkenyl, aryl, or aryloxy groups, $R^5$ and $R^4$ are each independently absent or an alkyleneoxy, or poly(alkyleneoxy) group, which may optionally be substituted on one or more carbon atoms of such alkyleneoxy, or poly(alkyleneoxy) group, by hydroxyl, alkyl, hydroxyalkyl, alkoxy, alkenyl, aryl, or aryloxy groups, $R^6$ $R^8$ and $R^7$ are each independently H, or ($C_1$-$C_{30}$) hydrocarbon, which hydrocarbon may optionally be substituted on one or more carbon atoms by hydroxyl, fluorine, alkyl, alkenyl or aryl and/or interrupted at one or more sites by an O, N, or S heteroatom, or -$POR^9R^{10}$, $R^9$ and $R^{10}$are each independently hydroxyl, alkoxy, aryloxy, or ($C_1C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3), and (b)(II) a vinyl alcohol material selected from the group consisting of:

(b)(II)(1) polymers comprising monomeric units according to structure (I-a):

(I-a)

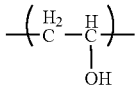

(b)(II)(2) salts of polymers (b)(II)(1).

(b)(II)(3) reaction products of two or more molecules of one or more polymers (b)(II)(1), and (b)(II)(4) mixtures comprising two or more of the polymers, salts, and/or reaction products of (b)(II)(1 ). (b)(II)(2). and (b)(II)(3); wherein the layer comprises at least one member selected from the group consisting of sequestering agents, scale-inhibiting agents, bleaching agents, bleaching catalysts, antifoaming agents, abrasives, enzymes, or agents which inhibit the corrosion of metals.

2. The article of claim 1, the layer further comprising a surface-active agent.

3. A method for hydrophilizing a substrate having a hydrophobic surface, comprising treating at least a portion of such hydrophobic surface with a treatment composition comprising:

(a) a surface-active agent; and (b)(I) an organophosphorus material selected from the group consisting of:

(b)(I)(1) organophosphorus compounds according to structure (I):

(I)

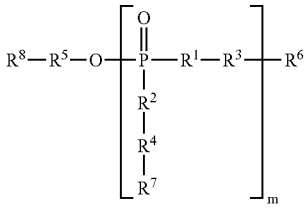

wherein:

each $R^1$ and $R^2$ are independently absent or O, provided that at least one of $R^1$ and $R^2$ is O, each $R^3$ is independently an alkyleneoxy, or poly (alkyleneoxy) group, which may optionally be substituted on one or more carbon atoms of such alkyleneoxy, or poly(alkyleneoxy) group by hydroxyl, alkyl , hydroxyalkyl, alkoxy, alkenyl, aryl, or aryloxy groups, $R^5$ and $R^4$ are each independently absent or an alkyleneoxy, poly(alkyleneoxy) group, which may optionally be substituted on one or more carbon atoms of such alkyleneoxy, or poly(alkyleneoxy) group by hydroxyl, alkyl hydroxyalkyl, alkoxy, alkenyl, aryl, or aryloxy groups, $R^6$ $R^8$ and $R^7$ are each independently H, or ($C_1$-$C_{30}$) hydrocarbon, which hydrocarbon may optionally be substituted on one or more carbon atoms by hydroxyl, fluorine, alkyl, alkenyl or aryl and/or interrupted at one or more sites by an O, N, or S heteroatom, or -$POR^9R^{10}$ $R^9$ and $R^{10}$are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3), and (b)(II) a vinyl alcohol material selected from the group consisting of:

(b)(II)(1) polymers comprising monomeric units according to structure (I-a):

(I-a)

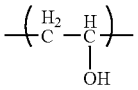

(b)(II)(2) salts of polymers (b)(II)(1).

(b)(II)(3) reaction products of two or more molecules of one or more polymers (b)(II)(1), and (b)(II)(4) mixtures comprising two or more of the polymers, salts, and/or reaction products of (b)(II)(1), (b)(II)(2), and (b)(II)(3); wherein the composition comprises at least one member selected from the group consisting of sequestering agents, scale-inhibiting agents, bleaching agents, bleaching catalysts, anti-foaming agents, abrasives, enzymes, or agents which inhibit the corrosion of metals, to deposit a hydrophilizing layer on at least a portion of such hydrophobic surface.

4. A composition for the cleaning in an aqueous or aqueous/alcoholic medium of hard surfaces comprising:

(a) at least one surface-active agent, and (b)(I) an organophosphorus material selected from the group consisting of:

(b)(I)(1) organophosphorus compounds according to structure (I):

(I)

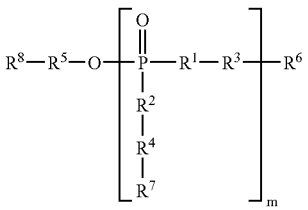

wherein:

each $R^1$ and $R^2$ are independently absent or O, provided that at least one of $R^1$ and $R^2$ is O, each $R^3$ is independently alkyleneoxy, poly(alkyleneoxy) group, which may optionally be substituted on one or more carbon atoms of such alkyleneoxy, or poly(alkyleneoxy) group by hydroxyl, alkyl , hydroxyalkyl, alkoxy, alkenyl, aryl, or aryloxy groups, $R^5$ and $R^4$ are each independently absent or an alkyleneoxy, or poly(alkyleneoxy) group, which may optionally be substituted on one or more carbon atoms of such alkyleneoxy, or poly(alkyleneoxy) group, by hydroxyl, alkyl, hydroxyalkyl, alkoxy, alkenyl, aryl, or aryloxy groups, $R^6$ $R^8$ and $R^7$ are each independently H, or ($C_1$-$C_{30}$) hydrocarbon, which hydrocarbon may optionally be substituted on one or more carbon atoms by hydroxyl, fluorine, alkyl, alkenyl or aryl and/or interrupted at one or more sites by an O, N, or S heteroatom, or -$POR^9R^{10}$, $R^9$ and $R^{10}$ are each independently hydroxyl, alkoxy, aryloxy, or ($C_1$-$C_{30}$)hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3), and (b)(II) a vinyl alcohol material selected from the group consisting of:

(b)(II)(1) polymers comprising monomeric units according to structure (I-a):

(I-a)

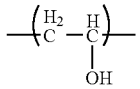

(b)(II)(2) salts of polymers (b)(II)(1), (b)(II)(3) reaction products of two or more molecules of one or more polymers (b)(II)(1), and (b)(II)(4) mixtures comprising two or more of the polymers, salts, and/or reaction products of (b)(II)(1), (b)(II)(2), and (b)(II)(3); wherein the composition comprises at least one member selected from the group consisting of sequestering agents, scale-inhibiting agents, bleaching agents, bleaching catalysts, anti-foaming agents, abrasives, enzymes, or agents which inhibit the corrosion of metals.

5. The composition of claim 4, wherein the organophosphorus material represents from 0.001 to 10% by weight of said composition.

6. The composition of claim 4, wherein the at least one surface-active agent represents from 0.005 to 60%, by weight of said composition.

7. The composition of claim 4, additionally comprising at least one additive selected from the group consisting of inorganic detergency adjuvants (builders), fillers, agents which influence the pH, polymers capable of controlling the viscosity of the mixture and/or the stability of the foams, hydrotropic agents, hydrating or moisturizing agents, biocides or disinfectants, solvents with a cleaning or degreasing activity, industrial cleaners, water-soluble organic solvents with little cleaning effect, cosolvents, fragrances, or colorants.

8. The composition of claim 4, for the cleaning or rinsing of hard surfaces made of ceramic, glass, metal, synthetic resin or plastic.

9. The composition of claim 4, for domestic use, for the cleaning or rinsing of the bathroom, the kitchen, floors made of linoleum, tiling or cement, toilet bowls, windows or mirrors, or dishes, by hand or in a machine.

10. The composition of claim 4, for industrial or communal use, for the cleaning or rinsing of reactors, steel blades, sinks, tanks, dishes, exterior or interior surfaces of buildings, windows of buildings, including apartment buildings, or bottles.

11. The composition of claim 4, wherein it exhibits a pH of at least 7.5 and comprises from 0.001 to 5% by weight of the organophosphorus material.

12. The composition of claim 4, wherein it exhibits a pH of at least 7.5 and comprises from 0.005 to 2%, by weight of the organophosphorus material.

13. The composition of claim 4, additionally comprising at least one additive selected from the group consisting of sequestering or scale-inhibiting agents, cationic biocides or disinfectants, surface-active agents, pH modifiers, water, cleaning or degreasing organic solvents, cosolvents, water-soluble organic solvents with little cleaning effect, bleaching agents or fragrances.

14. A composition for the cleaning in an aqueous or aqueous/alcoholic medium of hard kitchen surfaces comprising:

(a) at least one surface-active agent, and (b)(I) an organophosphorus material selected from:

(b)(I)(1) organophosphorus compounds according to structure (I):

(I)

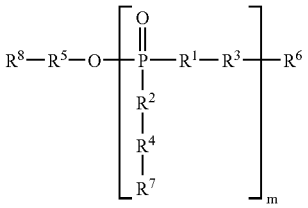

wherein:

each $R^1$ is and each $R^2$ is independently absent or O, provided that at least one of $R^1$ and $R^2$ is O, each $R^3$ is independently alkyleneoxy, poly(alkyleneoxy) group, which may optionally be substituted on one or more carbon atoms of such alkyleneoxy, or poly(alkyleneoxy) group by hydroxyl, alkyl, hydroxyalkyl, alkoxy, alkenyl, aryl, or aryloxy, $R^5$ is and each $R^4$ is independently absent or an alkyleneoxy, poly(alkyleneoxy), which may optionally, be substituted on one or more carbon atoms of such alkyleneoxy, or poly(alkyleneoxy) group by hydroxyl, alkyl, hydroxyalkyl, alkoxy, alkenyl, aryl, or aryloxy, $R^6$ and $R^8$ are each and each $R^7$ is independently H, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, or $-POR^9R^{10}$, $R^9$ and $R^{10}$ are each independently hydroxyl, alkoxy, aryloxy, or $(C_1\text{-}C_{30})$hydrocarbon, which hydrocarbon may optionally be substituted on one or more carbon atoms by hydroxyl, fluorine, alkyl, alkenyl or aryl and/or interrupted at one or more sites by an O, N, or S heteroatom, and m is an integer of from 1 to 5, (b)(I)(2) salts of organophosphorus compounds according to structure (I), (b)(I)(3) condensation reaction products of two or more molecules of one or more organophosphorus compounds according to structure (I), and (b)(I)(4) mixtures comprising two or more of the compounds, salts, and/or reaction products of (b)(I)(1), (b)(I)(2), and (b)(I)(3), and (b)(II) a vinyl alcohol material selected from:

(b)(II)(1) polymers comprising monomeric units according to structure (I-a):

(I-a)

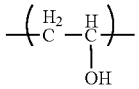

(b)(II)(2) salts of polymers (b)(II)(1), (b)(II)(3) reaction products of two or more molecules of one or more polymers (b)(II)(1), and (b)(II)(4) mixtures comprising two or more of the polymers, salts, and/or reaction products of (b)(II)(1), (b)(II)(2), and (b)(II)(3); wherein the composition comprises at least one member selected from the group consisting of sequestering agents, scale-inhibiting agents, bleaching agents, bleaching catalysts, antifoaming agents, abrasives, enzymes, or agents which inhibit the corrosion of metals; and further comprises:

from 0.001 to 1% by weight of the organophosphorus material, from 1 to 10% by weight of a solvent, from 1 to 5% by weight of an additional cleaning or degreasing solvent, from 0 to 2% by weight of monoethanolamine, from 0 to 10% by weight of at least one non-cationic surface-active agent, from 0 to 1 % by weight of at least one cationic surface-active agent with a disinfecting property, the total amount of surface-active agent(s) representing from 1 to 50% by weight, from 0 to 2% by weight of a dicarboxylic acid as scale-inhibiting agent, from 0 to 5% of a bleaching agent, and from 70 to 98% by weight of water.

15. The composition of claim 14, comprising from 0 to 1% by weight of at least one cationic surface-active agent with a disinfecting property comprising a mixture of (n-alkyl)dimethyl(ethylbenzyl)ammonium chloride and (n-alkyl)dimethylbenzylammonium chloride).

16. The composition of claim 14, having a pH of 7.5 to 13.

17. The composition of claim 14, having a pH of 8 to 12.

18. The composition of claim 4, having a pH of less than 5, further comprising an inorganic or organic acidic agent, and from 0.001 to 5% by weight of the organophosphorus material.

19. The composition of claim 4, having a pH of less than 5, further comprising an inorganic or organic acidic agent, and from 0.01 to 2% by weight of the organophosphorus material.

20. The composition as claimed in claim 4, wherein the surfactant is selected from the group consisting of nonionic, amphoteric, zwitterionic or anionic surface-active agents or their mixtures, and wherein the composition further comprises at least one additive selected from the group consisting of cationic biocides or disinfectants, thickening agents, additional solvents, or fragrances.

21. The composition as claimed in claim 4, intended for the cleaning of toilet bowls, comprising:

from 0.5 to 10% by weight of the at least one surface-active agent, from 0.05 to 5% by weight of the organophosphorus material, and further comprising:

from 0.1 to approximately 40% by weight of at least one acidic cleaning agent, optionally from 0.1 to 2% by weight of at least one cationic surface-active agent with a disinfecting property, optionally from 0.1 to 3% by weight of at least one thickening agent, optionally from 1 to 10% by weight of at least one bleaching agent, optionally a preservative, a colorant, a fragrance or an abrasive, and from 50 to 95% by weight of water, and has a pH of 0.5 to 4.

22. The composition as claimed in claim 4, intended for the cleaning of toilet bowls, comprising:

from 0.01 to 2%, by weight of organophosphorus material, and further comprising:

between 0.5 and approximately 15% by weight of at least one acidic cleaning agent, from 0.5 to 10% by weight of at least one anionic or nonionic surface-active agent, optionally from 0.1 to 2% by weight of a mixture of (n-alkyl)dimethyl-(ethylbenzyl) ammonium chloride and (n-alkyl)dimethylbenzylammonium chloride, optionally from 0.1 to 3% by weight of at least one gum, optionally from 1 to 10% by weight of at least one bleaching agent, optionally a preservative, a colorant, a fragrance or an abrasive, and from 50 to 95% by weight of water, and a pH of at most 5.

23. The composition of claim 4, wherein the composition is for the cleaning of windows, further comprising:

from 0.001 to 10% by weight of at least one polybetaine (B), from 0.005 to 20% by weight of at least one nonionic and/or anionic surface-active agent, from 0 to 10% by weight of at least one amphoteric surface-active agent, from 0 to 30% by weight of at least one solvent, and has a pH of 6 to 11.

24. The composition of claim 23, wherein the solvent comprises an alcohol.

25. The composition of claim 4, wherein the composition is for the cleaning of windows, further comprising:

from 0.005 to 3% by weight of at least one polybetaine (B), from 0.5 to 10% by weight of at least one nonionic and/or anionic surface-active agent, from 0.5 to 5% by weight of at least one amphoteric surface-active agent, from 0.5 to 15% by weight of at least one solvent, and having a pH of6to 11.

26. The composition of claim 4, wherein the composition is for the washing of dishes in automatic dishwashers, comprising:

from 0.01 to 5% by weight of said organophosphorus material, from 0.2 to 10% by weight of said at least one surface-active agent, and optionally further comprising:

up to 90% by weight of at least one detergency adjuvant (builder), up to 10% by weight of at least one auxiliary cleaning agent, up to 30% by weight of at least one bleaching agent which may or may not be combined with a bleaching activator, up to 50% by weight of at least one filler, and having a pH of 8 to 13.

27. The composition of claim 4, wherein the composition is for the washing of dishes in automatic dishwashers, comprising:

from 0.01 to 5%, advantageously from 0.1 to 3%, by weight of said organophosphorus material, and further comprising:

from 0.5 to 5% by weight of at least one nonionic surface-active agent, and optionally:

up to 90% by weight of at least one detergency adjuvant (builder), from 1 to 10% by weight of at least one auxiliary cleaning agent, up to 30% by weight of at least one bleaching agent selected from the group consisting of perborate, or percarbonate and mixtures thereof, which may or may not be combined with a bleaching activator, up to 50% by weight of at least one filler selected from the group consisting of sodium sulfate or sodium chloride, and having a pH of 8 to 13.

28. The composition of claim 4, wherein the composition is for the washing of dishes in automatic dishwashers, comprising:

from 0.1 to 3%, by weight of said organophosphorus material, and further comprising:

from 0.5 to 5%, by weight of at least one nonionic surface-active agent, and optionally:

up to 90% by weight of at least one detergency adjuvant (builder), 2 to 8%, by weight of at least one auxiliary cleaning agent, up to 30% by weight of at least one bleaching agent selected from the group consisting of perborate, or percarbonate and mixtures thereof, which may or may not be combined with a bleaching activator, up to 50% by weight of at least one filler selected from the group consisting of sodium sulfate or sodium chloride, and having a pH of 8 to 13.

29. The composition as claimed in claim 4, wherein the composition is intended for rinsing of dishes in automatic dishwashers, comprising:

from 0.02 to 10% by weight of said organophosphorus material, from 0.1 to 20% by weight of said at least one surface-active agent, and further comprising:

from 0 to 10% by weight of at least one calcium-sequestering organic acid, from 0 to 15% by weight of at least one auxiliary detergency agent, at most 1 % by weight of at least one enzyme, enzyme stabilizer or enzyme activator, at most 10% by weight of at least one dispersant, acrylate copolymer or mixture thereof, having a pH of 4 to 7.

30. The composition as claimed in claim 4, wherein the composition is intended for rinsing of dishes in automatic dishwashers, comprising:

from 0.1 to 5%, by weight of said organophosphorus material, and further comprising:

from 0.2 to 15% by weight of at least one nonionic surface-active agent, from 0.5 to 5% by weight of citric acid, from 0.5 to 10% by weight of at least one auxiliary detergency agent selected from the group consisting of a copolymer of acrylic acid and of maleic anhydride or acrylic acid homopolymers, and having a pH of 4 to 7.

31. The composition of claim 4, wherein the composition is intended for the washing of dishes by hand, comprising:

from 0.1 to 10% by weight of said organophosphorus material, from 3 to 50% by weight of said at least one surface-active agent, and optionally further comprising:

at least one nonionic surface-active agent, at least one non-cationic bactericide or disinfectant, at least one synthetic cationic polymer agent, at least one polymer capable of controlling the viscosity of the mixture and/or the stability of the foams, at least one hydrotropic agent, at least one hydrating or moisturizing agent or agent for protecting the skin, and having a pH of 5 to 9.

32. The composition of claim 4, wherein the composition is intended for the washing of dishes by hand, comprising:

from 0.1 to 10% by weight of said organophosphorus material, from 10 to 40%, by weight of said at least one surface-active agent comprising an anionic surface-active agent, and optionally further comprising:

at least one nonionic surface-active agent, at least one non-cationic bactericide or disinfectant comprising triclosan, at least one synthetic cationic polymer agent, at least one polymer capable of controlling the viscosity of the mixture and/or the stability of the foams, at least one hydrotropic agent, at least one hydrating or moisturizing agent or agent for protecting the skin, and having a pH of 5 to 9.

33. The composition of claim 4, wherein it is intended for the exterior washing of motorized vehicles, comprising:

from 0.005 to 10% by weight of said organophosphorus material, and further comprising:

from 0 to 30% by weight of at least one nonionic surface-active agent, from 0 to 30% by weight of at least one anionic surface-active agent, from 0 to 30% by weight of at least one amphoteric and/or zwitterionic surface- active agent, from 0 to 30% by weight of at least one cationic surface-active agent, the minimum amount of surface-active agent being at least 0.5% by weight, from 0 to 99% by weight of at least one detergency adjuvant (builder), optionally a hydrotropic agent, fillers or pH modifiers, optionally a solvent, and having a pH of 8 to 13.

34. The composition of claim 4, wherein it is intended for the exterior washing of motorized vehicles, comprising:

from 0.005 to 10% by weight of said organophosphorus material, and further comprising:

from 0.1 to 15% by weight of at least one nonionic surface-active agent, from 0.1 to 15% by weight of at least one anionic surface-active agent, from 0.01 to 10% by weight of at least one amphoteric and/or zwitterionic surface-active agent, from 0.05 to 15% by weight of at least one cationic surface-active agent, the minimum amount of surface-active agent being at least 0.5% by weight, from 40 to 98% by weight of at least one detergency adjuvant (builder), optionally a hydrotropic agent, fillers or pH modifiers, and having a pH of 8 to 13.

35. The composition of claim 4, wherein it is intended for the cleaning of ceramic surfaces, comprising:

from 0.02 to 5% by weight of said organophosphorus material, and further comprising:

from 0 to 30% by weight of at least one nonionic surface-active agent, from 0 to 30% by weight of at least one anionic surface-active agent, the total amount of surface-active agent representing from 0.5 to 50% by weight, from 0 to 25% by weight of at least one detergency adjuvant (builder), from 0 to 2% by weight of a foam modifier, and having a pH of 2 to 12.

36. The composition of claim 4, wherein it is intended for the cleaning of ceramic surfaces, comprising:

from 0.02 to 5% by weight of said organophosphorus material, and further comprising:

from 0 to 20% by weight of at least one nonionic surface-active agent, from 0 to 20% by weight of at least one anionic surface-active agent, the total amount of surface-active agent representing from 1 to 30%, more particularly from 2 to 20% by weight, from 0.1 to 25% by weight of at least one detergency adjuvant (builder), from 0.005 to 2% by weight of a foam modifier, and having a pH of 2 to 12.

37. The composition of claim 4, wherein it is intended for the cleaning of ceramic surfaces, comprising:

from 0.02 to 5% by weight of said organophosphorus material, and further comprising:

from 0 to 20% by weight of at least one nonionic surface-active agent, from 0 to 20% by weight of at least one anionic surface-active agent, the total amount of surface-active agent representing from 2 to 20% by weight, from 0.1 to 25% by weight of at least one detergency adjuvant (builder), from 0.5 to 2% by weight of a foam modifier, and having a pH of 2 to 12.

38. The composition of claim 4, wherein it is intended for the rinsing of shower walls, comprising:

from 0.02 to 5% by weight of said organophosphorus material, and further comprising:

from 0.5 to 5% by weight of at least one nonionic surface-active agent, water,
optionally at least one lower alcohol,
optionally from 0.01 to 5% by weight of at least one metal-chelating agent, and
having a pH of7to 11.

39. The composition of claim 4, wherein it is intended for the rinsing of shower walls, comprising:
from 0.05 to 1 %, by weight of said organophosphorus material, and further comprising:
from 0.5 to 5% by weight of at least one nonionic surface-active agent comprising a polyethoxylated fatty acid ester,
water,
optionally at least one lower alcohol,
optionally from 0.01 to 5% by weight of at least one metal-chelating agent, and
having a pH of7to 11.

40. The composition of claim 4, wherein it is intended for the cleaning of glass-ceramic sheets, comprising:
from 0.01 to 5% by weight of said organophosphorus material, and further comprising:
from 0.1 to 1% by weight of at least one thickening agent,
from 10 to 60% by weight of at least one abrasive agent,
from 1 to 10% by weight of at least one nonionic surface-active agent,
from 0 to 7% by weight of at least one solvent,
optionally basifying or sequestering agents, and
having a pH of 7 to 12.

41. The composition of claim 40, wherein the at least one abrasive agent comprises calcium carbonate or silica, and the at least one solvent comprises butyl diglycol.

42. The composition of claim 4, wherein it is intended for the cleaning of reactors, comprising:
from 0.02 to 5% by weight of said organophosphorus material, and further comprising:
from 1 to 50% by weight of at least one alkali metal salt,
from 1 to 30% by weight of a mixture of surface-active agents,
from 0 to 30% by weight of at least one solvent, and
having a pH of 8 to 14.

43. The composition of claim 4, wherein it is intended for the cleaning of reactors, comprising:
from 0.02 to 5% by weight of said organophosphorus material, and further comprising:
from 1 to 50% by weight of at least one alkali metal salt selected from the group consisting of a sodium or potassium phosphate, carbonate or silicate,
from 1 to 30% by weight of a mixture of surface-active agents selected from the group consisting of nonionic and anionic surface-active agents, very particularly of ethoxylated fatty alcohols and of laurylbenzenesulfonate,
from 0 to 30% by weight of at least one solvent, and
having a pH of 8 to 14.

44. The composition of claim 43, wherein the mixture of surface-active agents comprises ethoxylated fatty alcohols and laurylbenzenesulfonate, and the solvent comprises diisobutyl ether.

45. A method of use comprising, cleaning or rinsing hard surfaces with the composition of claim 7 to contribute to said surfaces antideposition and/or antiadhesion properties with regard to soiling substances capable of being deposited on said surfaces.

46. A method for improving the properties of a composition comprising (a) at least one surface-active agent, for cleaning or rinsing hard surfaces in an aqueous or aqueous/alcoholic medium, comprising adding to said composition:

(b)(I) an organophosphorus material selected from the group consisting of:
(b)(I)(1) organophosphorus compounds according to structure (I):

(I)

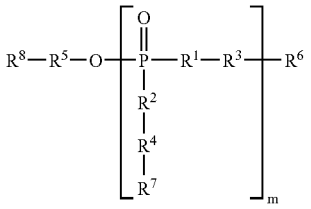

wherein:
each $R^1$ and $R^2$ are independently absent or O, provided that at least one of $R^1$ and $R^2$ is O,
each $R^3$ is independently alkyleneoxy, poly(alkyleneoxy) group, which may optionally be substituted on one or more carbon atoms of such alkyleneoxy, or poly(alkyleneoxy) group by hydroxyl, alkyl , hydroxyalkyl, alkoxy, alkenyl, aryl, or aryloxy groups,
$R^5$ and $R^4$ are each independently absent or an alkyleneoxy, or poly(alkyleneoxy) group, which may optionally be substituted on one or more carbon atoms of such alkyleneoxy, or poly(alkyleneoxy) group, by hydroxyl, alkyl, hydroxyalkyl, alkoxy, alkenyl, aryl, or aryloxy groups,
$R^6$ $R^8$ and $R^7$ are each independently H, or ($C_1$-$C_{30}$) hydrocarbon, which hydrocarbon may optionally be substituted on one or more carbon atoms by hydroxyl, fluorine, alkyl, alkenyl or aryl and/or interrupted at one or more sites by an O, N, or S heteroatom, or -$POR^9R^{10}$,
$R^9$ and $R^{10}$are each independently hydroxyl, alkoxy, aryloxy, or ($C_1$-$C_{30}$) hydrocarbon, which hydrocarbon may optionally be substituted on one or
more carbon atoms by hydroxyl, fluorine, alkyl, alkenyl or aryl and/or interrupted at one or more sites by an 0, N, or S heteroatom, and
m is an integer of from 1 to 5,
(b)(I)(2) salts of organophosphorus compounds according to structure (I),
(b)(I)(3) condensation reaction products of two or more molecules of one or more organophosphorus compounds according to structure (I), and
(b)(I)(4) mixtures comprising two or more of the compounds, salts, and/or reaction products of (b)(I)(1), (b)(I)(2), and (b)(I)(3), and (b)(II) a vinyl alcohol material selected from the group consisting of:
(b)(II)(1) polymers comprising monomeric units according to structure (I-a):

(I-a)

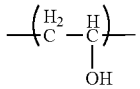

(b)(II)(2) salts of polymers (b)(II)(1),
(b)(II)(3) reaction products of two or more molecules of one or more polymers (b)(II)(1), and (b)(II)(4) mixtures comprising two or more of the polymers. salts, and/or reaction products of (b)(II)(1 ), (b)(II)(2), and (b)(II)(3); wherein the composition comprises at least one member selected from the group consisting of sequestering agents, scale-inhibiting agents, bleaching agents, bleaching catalysts, antifoaming agents, abrasives, enzymes, or agents which inhibit the corrosion of metals.

47. The method of claim 46, wherein said organophosphorus material is added in an amount sufficient to contribute to said surfaces antideposition and/or antiadhesion properties with regard to soiling substances capable of being deposited on said surfaces.

48. A method for facilitating the cleaning or rinsing of hard surfaces by bringing said surfaces into contact with a composition according to claim 4 in an aqueous or aqueous/alcoholic medium.

49. The method of claim 48, wherein said organophosphorus material is added in an amount sufficient to contribute to said surfaces antideposition and/or antiadhesion properties with regard to soiling substances capable of being deposited on said surfaces.

50. The composition of claim 14, wherein the at least one non-cationic surface-active agent comprises an amphoteric or nonionic surface-active agent.

51. The composition of claim 34, wherein the at least one surface-active agent comprises a nonionic surface-active agent.

* * * * *